US006954968B1

(12) United States Patent
Sitbon

(10) Patent No.: US 6,954,968 B1
(45) Date of Patent: Oct. 18, 2005

(54) DEVICE FOR MUTUALLY ADJUSTING OR FIXING PART OF GARMENTS, SHOES OR OTHER ACCESSORIES

(76) Inventor: Eric Sitbon, 14, cité Moynet, 75012 Paris (FR)

( * ) Notice: Subject to any disclaimer, the term of this patent is extended or adjusted under 35 U.S.C. 154(b) by 0 days.

(21) Appl. No.: 09/857,347

(22) PCT Filed: Dec. 3, 1999

(86) PCT No.: PCT/FR99/03017

§ 371 (c)(1),
(2), (4) Date: Jan. 4, 2002

(87) PCT Pub. No.: WO00/33328

PCT Pub. Date: Jun. 8, 2000

(30) Foreign Application Priority Data

Dec. 3, 1998 (FR) ..... 98 15307

(51) Int. Cl.[7] ..... A44B 21/00
(52) U.S. Cl. ..... 24/303; 2/269; 36/50.1
(58) Field of Search ..... 24/303; 2/311, 2/312, 338, 327, 85, 96, 93, 269, 270, 251, 227, 219, 218, 237, 236, 235, 108, 141.1; 36/50.1, 50.5; 340/568.1, 568.2

(56) References Cited

U.S. PATENT DOCUMENTS 2,110,645 A * 3/1938 Carley ..... 24/114.7
2,389,298 A * 11/1945 Ellis ..... 335/303
3,529,328 A * 9/1970 Davison ..... 24/303
4,941,236 A * 7/1990 Sherman et al. ..... 24/303
5,682,653 A * 11/1997 Berglof et al. ..... 24/303
5,926,925 A * 7/1999 Hicks ..... 24/303
6,006,363 A * 12/1999 Karlin ..... 2/228
6,035,449 A * 3/2000 Galler et al. ..... 2/249

FOREIGN PATENT DOCUMENTS

FR 2543676 A * 10/1984 ..... G01D/5/06
JP 63282601 A * 11/1988 ..... G01B/7/12

* cited by examiner

*Primary Examiner*—James R. Brittain
(74) *Attorney, Agent, or Firm*—Stites & Harbison PLLC; Douglas E. Jackson

(57) ABSTRACT

The invention relates to a device (1) for holding together, adjusting, fitting or fastening parts of a garment, shoe or any other accessory. It contains a first part (2) comprising a sheath (3) in which a first magnet or ferromagnetic element (4) is inserted, these being movable inside the first sheath, and a second part (5) containing a second magnet or ferromagnetic element (6) subject or submitted to the magnetic attraction of the first magnet or ferromagnetic element of the first part, and is used to hold together, adjust, fit or fasten the garment, shoe or accessory when one of the said first and second parts (2, 5) is activated by a user to work in conjunction or alterations is thus possible through the sliding (7) of the first magnet or ferromagnetic element (4) in the first sheath (3).

46 Claims, 41 Drawing Sheets

Figure 1A:
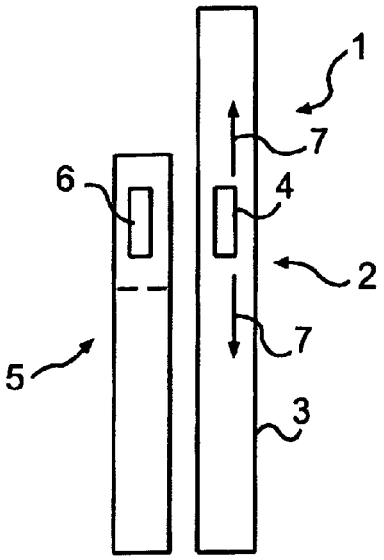

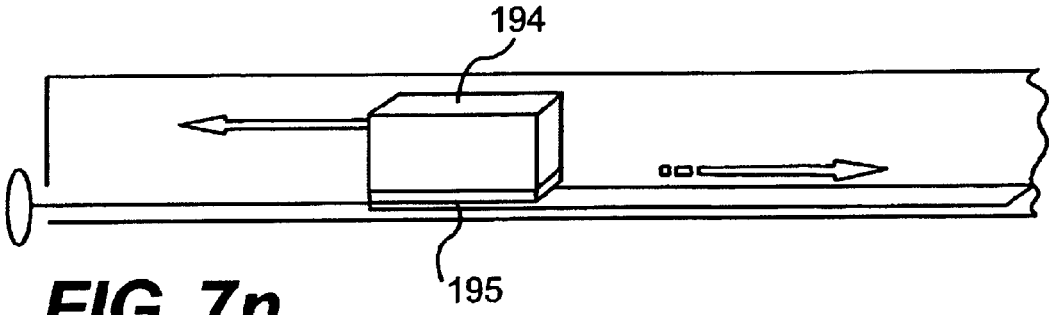
FIG. 7n
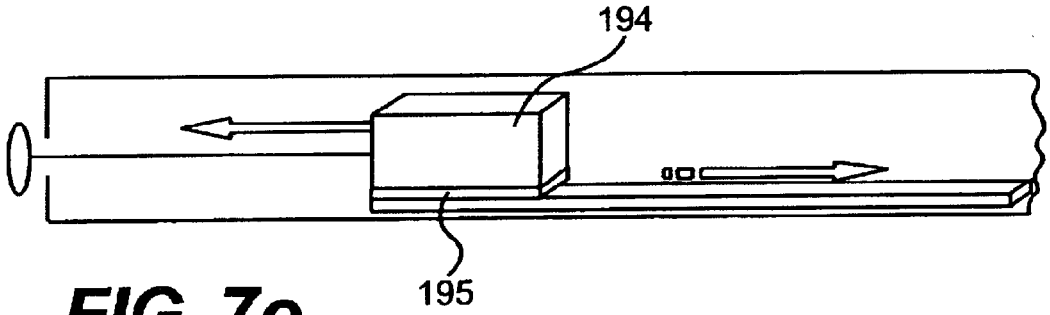
FIG. 7o
FIG. 7p
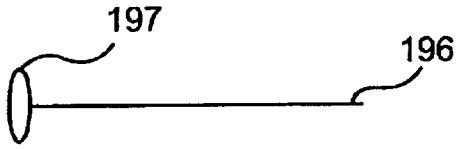
FIG. 7q
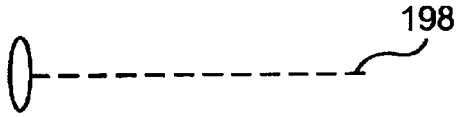
FIG. 7r
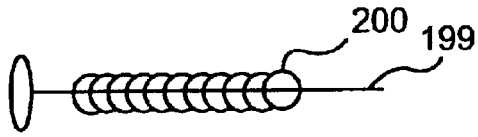
FIG. 7s
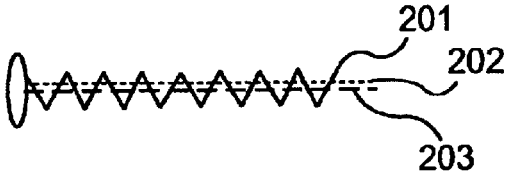

DEVICE FOR MUTUALLY ADJUSTING OR FIXING PART OF GARMENTS, SHOES OR OTHER ACCESSORIES

This invention relates to a device for holding together, adjusting, fitting or fastening parts of a garment, shoe or any other accessory using magnetic elements.

Magnetic or ferromagnetic elements are constituents which play an important role in many devices in modern civilisation.

Those which are used in practice can be divided into two categories: soft materials, which are easily magnetised (high permeability and reversible effect), and hard materials which have strong residual magnetisation, and are used as permanent magnets.

In what follows the term ferromagnetic element shall be used to designate soft materials, the term magnet or magnetic element being used to designate hard materials which therefore form permanent magnets.

A magnet may be either a natural magnet or an artificial magnet, and can therefore vary considerably in its constitution. The latter can be easily shaped and adapted to the required usage so that they create a much stronger and more durable magnetisation than that of natural magnets and have good stability.

Reference will also be made below to the polarities or poles of the magnets used.

All magnets have two opposing areas called their poles, namely a positive pole or north pole (tendency to move towards north) and an opposing negative pole or south pole.

This invention is intended for not only clothing such as work coats, jackets, overalls, dresses, skirts or trousers, but also for shoes, or accessories such as belts, straps, etc. which contain adjustment devices using magnetic elements.

It therefore has a particularly important application, although not an exclusive one, in the area of sports shoes and clothing which require fast and effective sealing with respect to a hostile external environment, as for example in infectious hospital environments or the nuclear industry (radiation protection).

Devices for adjusting or fastening clothing or shoes are already well-known. Such devices have detachable fastening elements containing male elements and female elements, the latter being connectable to the said male elements, for example through pressure, buttons, Velcro®, zip fasteners or laces.

These different devices suffer from disadvantages.

They are not easily adjustable, requiring for example the user to unstitch or remove the elements in order to obtain the correct adjustment.

In addition, their adjustment always requires manual intervention on the part of the user, which is sometimes difficult for certain groups, for example the disabled, pregnant women, certain or underwater divers.

Belts which can be adjusted with magnets (U.S. Pat. No. 5,307,582) are also known, as are covers which can be fixed in place with magnets (FR-A-1.581.763).

Here again, these methods do not allow for optimised adjustment, as they are complicated and costly to use.

A system for fastening clothes (FR-A-2.492.938) is also known, this containing magnetic elements in rigid materials spaced along the edges of two ribbons in flexible material.

In addition, document FR-A-2.005.580 describes a system for fastening ski boots fitted with a magnetic safety device which prevents them from undoing accidentally.

Generally speaking, all these available systems using magnets to fasten two parts of a garment, a belt, a piece of luggage, a shoe, etc. have the male and female elements in a predetermined position with no possibility of quickly and easily changing the location of these elements.

The object of this invention is to provide an adjustable fastening device which better meets the requirements of practical applications than those known to date, notably in that it allows fastening and/or simplified adjustment of clothing, shoes or other accessories, in a robust and resistant way, allowing immediate and easy adjustment by the user.

People handicapped either by their condition, or by their environment, or people who perform repeated movements, will thus benefit from a simple, reliable, inexpensive and easily implemented fastening device.

To this end, this invention provides in particular a device for holding together, adjusting, fitting or fastening parts of a garment, shoe or any other accessory, wherein a first part containing at least one first sheath in which at least one first magnet or ferromagnetic element is inserted, these being movable inside the said first sheath, and a second part containing at least one second magnet or ferromagnetic element subject or submitted to the magnetic attraction of the first magnet or ferromagnetic element of the first part, are used to hold together, adjust, fit or fasten the garment, shoe or accessory when one of the said first and second parts is activated by a user to work in conjunction with the other part, a multitude of adjustments or alterations being possible through the sliding of the first magnet or ferromagnetic element in the said first sheath.

In preferred embodiments of the invention, one and/or other of the following arrangements may be used:

- the second magnet or ferromagnetic element is itself included and movable in a second sheath belonging to the second part;
- the second magnet or ferromagnetic element is attached to the second part;
- the first part and/or second part have two sheathes;
- one of the first and second parts is at least in part formed by a strap or braces;
- at least one of the first and second magnets or ferromagnetic elements is formed by a magnetised or ferromagnetic area on the said braces or strap belonging to the first or second corresponding part;
- one or more magnets or ferromagnetic elements of one part of the device are concave in shape, and the magnet(s) or ferromagnetic element(s) of the other part is(are) convex in shape and complementary to the said concave shape;
- one or more magnets or ferromagnetic elements are flat, trapezoid, rectangular, circular or triangular in shape;
- at least one magnet or ferromagnetic element of one part is cylindrical;
- the corresponding magnet or ferromagnetic element of the other part is flat;
- the corresponding magnet or ferromagnetic element of the other part is cylindrical;
- the device comprises the means for mechanically moving the sheath(es);
- at least one of the first and second parts has a series of at least two magnets or ferromagnetic elements hinged together;
- at least one of the magnets is surface-polarised;
- polarisation of at least one of the magnets is axial, parallel to the sheath;
- at least one of the magnets is multipolar;

the device contains at least two magnets in the same sheath, of opposite polarisation;

each magnet is associated with an anti-magnetic protection component;

at least one magnet being multipolar, it is sandwiched between two parts used to block the magnetic flux;

the magnet being of width d, the structural thickness of the device between the magnet and ferromagnetic element is less than d/12;

at least one magnet or ferromagnetic element is glued, welded or embedded on a support plate, for example in plastic or latex material, which can be stitched on;

the sheath also has a strip of ferromagnetic cloth along all or part of its length;

the sheath also has stitches sewn with ferromagnetic conductor wire along at least part of its length;

the magnets or ferromagnetic elements have rounded edges;

the magnets are produced from the family of rare earths of the type Neodymium Iron Boron.

The magnets are also preferably coated with a protective layer created through nickel/copper galvanisation.

it contains the means to activate the movable magnet(s) or ferromagnetic element(s) remotely;

the means for remote activation contain the means for motorisation of at least one of the movable magnets or ferromagnetic parts, allowing the mechanical movement of the corresponding sheath(es);

it contains the means for motorisation of at least one first and at least one second magnet or ferromagnetic element, capable of working in conjunction with the first one;

the means for remote activation include a microprocessor, used for automatic adjustment so that the item can be adapted during use, by limiting tightening, and thus ensuring optimum adjustment;

the means for remote activation also include a means for storing different adjustments, corresponding to different users or situations;

the means for remote activation include a photoelectric sensor, and/or a temperature sensor, and/or a humidity sensor;

the means for remote activation include an elastic or spring-operated traction system attached or connected to the movable magnet or ferromagnetic element, and capable of acting through the corresponding sheath, and a system for locking the said traction system in one or more preset positions;

the traction system is attached to the sheath, or passes through the said sheath;

at least one magnet or ferromagnetic element has a hole drilled through it transversally, for example parallel to the active (contact) surface, at a distance from the said surface, to prevent any accidents to the latter with respect to the continuity of its flatness;

at least one magnet is formed from a block drilled along its axis with at least one cylindrical hole and containing, on the side of one of its surfaces, a transverse channel parallel to the said surface and through which sewing thread can be run entirely below the said surface;

at least one magnet is formed from a block drilled along its axis with at least one cylindrical hole and containing, on the side of one of its surfaces, a cupel through which sewing thread can be run entirely below the said surface;

the magnet has two cylindrical holes;

the magnet(s) are covered with an anti-magnetic sheath on at least one surface;

the device also contains the means for detecting and signalling that the parts of the garment, shoe or any other accessory are correctly fastened or fitted;

the detection and signalling system contains a circuit of conductor wires connected to the magnets or ferromagnetic elements, the said magnets or ferromagnetic elements acting as contactors to close the circuit;

it also contains the means for triggering an alarm or sending a command if specific preset conditions are complied or not complied with;

the means for remote activation include a switch located in the sole of the shoe, which can be activated by the user when he puts his foot in the shoe, this allowing automatic adjustment of the shoe;

the sheath is extended by a piece of fabric to which the second magnet or ferromagnetic element is attached;

the garment is weighted inside the hem.

This invention also provides a shoe containing a device as described above.

In a preferred embodiment of the invention, the shoe has three solid sections, namely a right section, a left section and a central section, and two open sections, each one separating the two solid sections on either side of it, the device containing at least one strap fixed to the middle on the central section and fitted on both sides with sheathes containing movable magnets, used to bring the right and left sections towards the central section, in order to adjust tightening of the shoe.

The device also preferably has at least one adjustment strap containing a magnet or ferromagnetic part which disappears into the wall of the shoe, the motorisation system being capable of pulling or releasing the said strap automatically.

This invention also provides a garment containing a device as described above.

In a preferred embodiment, the garment contains a cloth, the weft of which is threaded with conductor wire connected to an alarm used to signal if the wire is cut and therefore that the garment is damaged.

This invention also provides an accessory such as braces or belts, bags, organisers and other types of leather goods containing a device as described above.

This invention will become better understood with regard to the following description of embodiments given hereafter by way of non-exhaustive example.

Reference shall now be made to the accompanying drawings, in which:

FIGS. 1*a,* 1*b,* 1*c* and 1*d* are schematic top views giving the embodiment principles of the first and second parts of the device according to the invention.

Figure 2A:
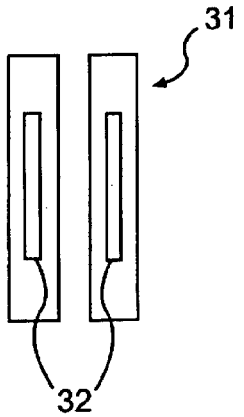

FIGS. 2*a,* 2*b,* 2*c* and 2*d* show schematically the variants of the first and second parts of the device according to the invention, comprising various forms of magnets and ferromagnetic elements.

Figure 2B:
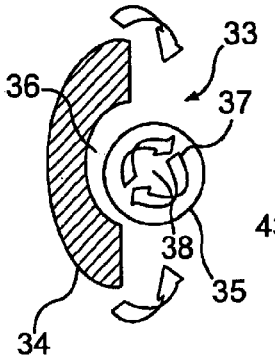
Figure 2C:
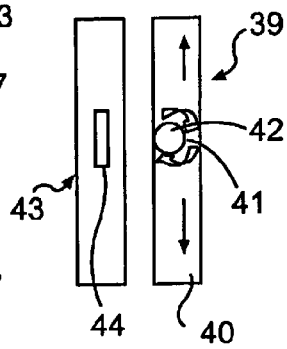
Figure 2D:
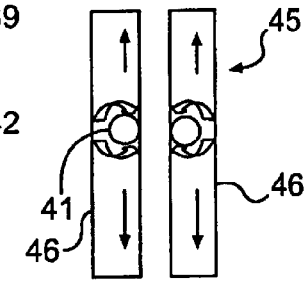
Figure 2E:
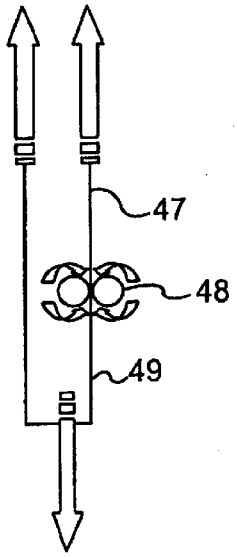
Figure 2F:
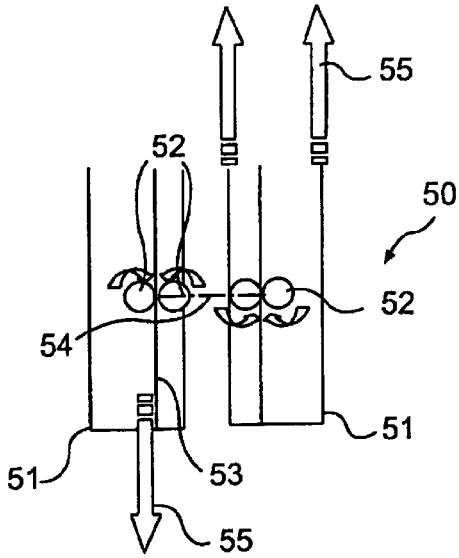

FIGS. 2*e* and 2*f* illustrate the operation of the two embodiments more specifically described here.

Figure 2G:
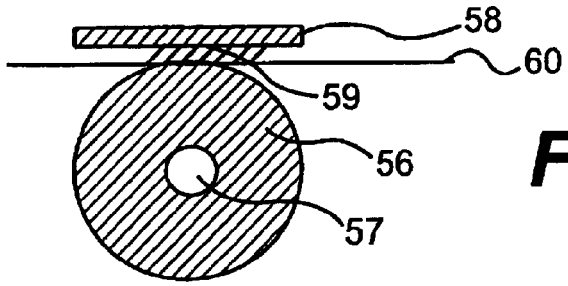

FIGS. 2*g,* 2*h,* 2*i,* 2*j* and 2*k* provide schematic enlarged views of magnet/ferromagnetic element pairings of different forms associated with spring-operated systems.

Figure 2H:
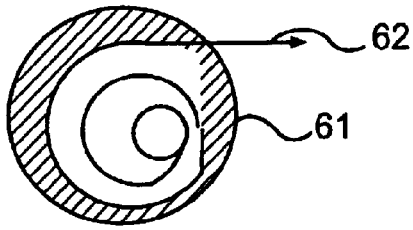
Figure 2I:
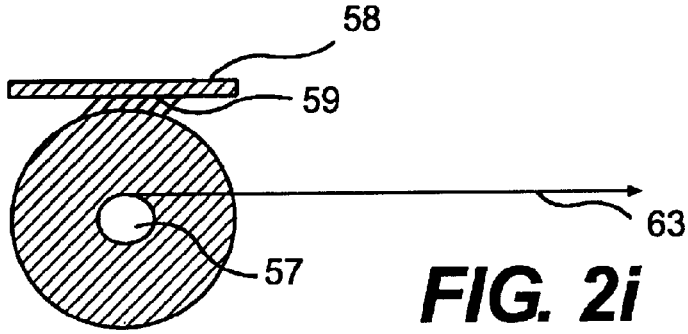
Figure 2J:
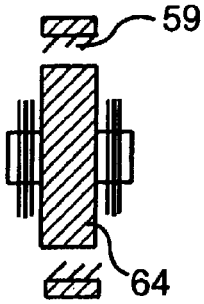
Figure 2K:
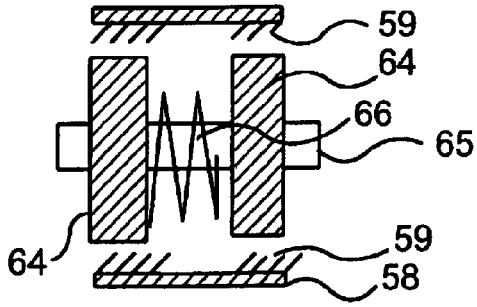
Figure 2L:
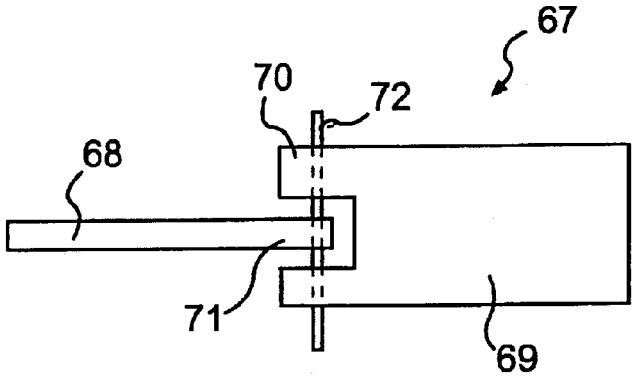
Figure 2M:
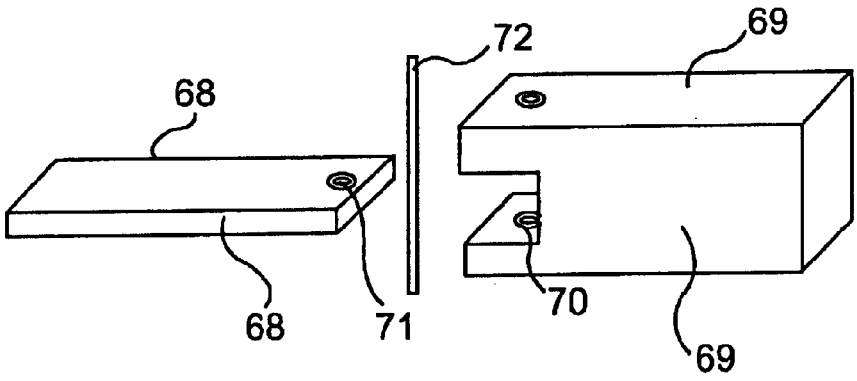

FIGS. 2*l* and 2*m* show a hinged magnet or ferromagnetic element which may be used with the invention.

Figure 2O:
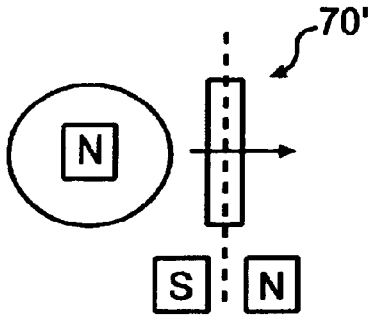

FIGS. 2*o,* 2*p,* 2*q,* 2*r,* 2*s,* 2*t,* 2*u,* 2*v,* 2*w,* 2*x* and 2*y* give the modes of polarisation which may be used with the magnets in the invention.

Figure 3A:
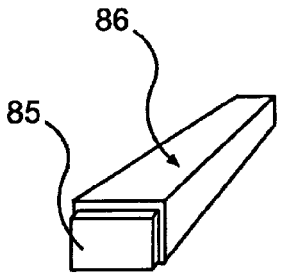
Figure 3B:
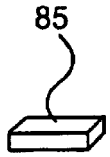
Figure 3C:
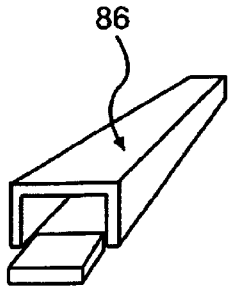
Figure 3D:
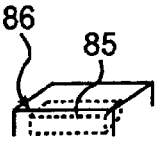

FIGS. 3*a,* 3*b,* 3*c,* 3*d,* 3*e* and 3*f* show perspective, top and cross-sectional views of different embodiments of magnets provided with anti-magnetic protection.

Figure 3E:
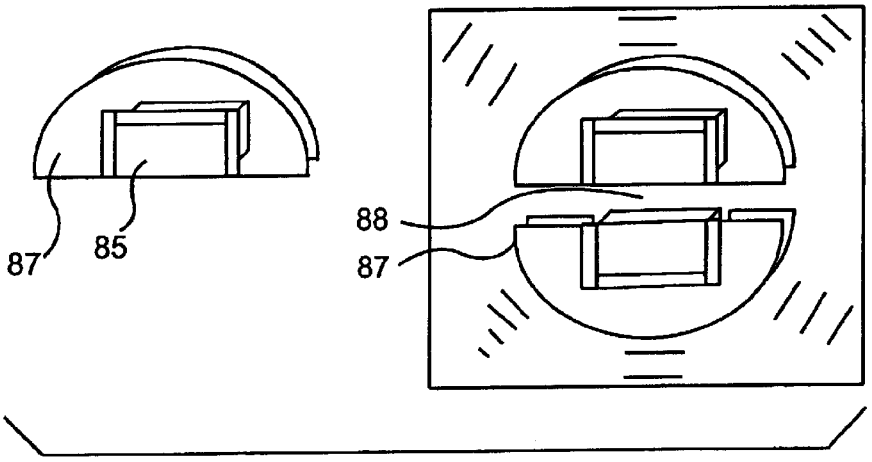
Figure 3F:
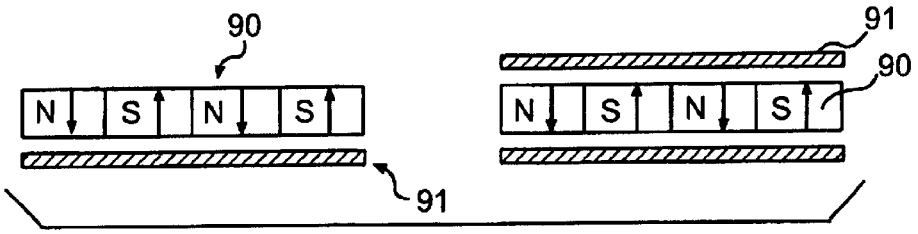
Figure 3G:
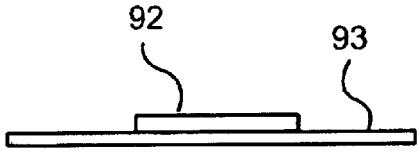
Figure 3H:
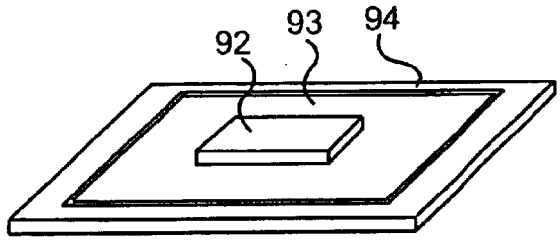

FIGS. 3*g* and 3*h* show cross-sectional and perspective views of an embodiment of a magnet or ferromagnetic element glued on a support which may be used with the invention.

Figure 3J:
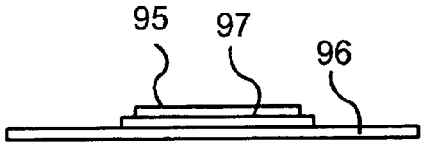
Figure 3K:
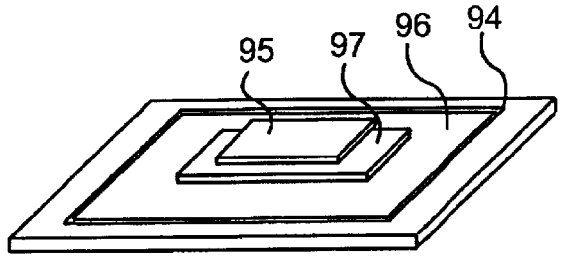

FIGS. 3*j* and 3*k* give another embodiment of a magnet or ferromagnetic element and its support which may be used with the invention, comprising in addition anti-magnetic protection.

Figure 3M:
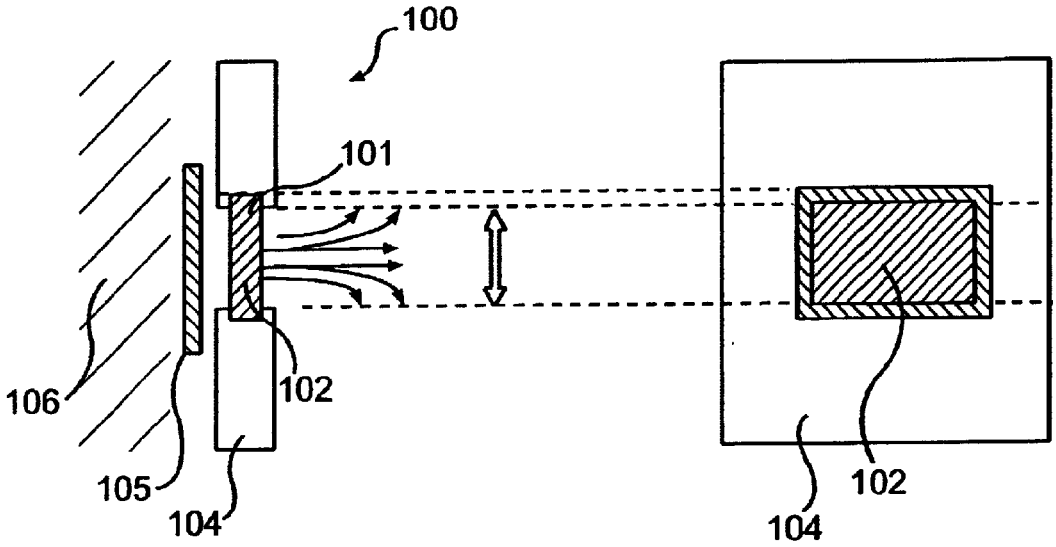
Figure 3N:
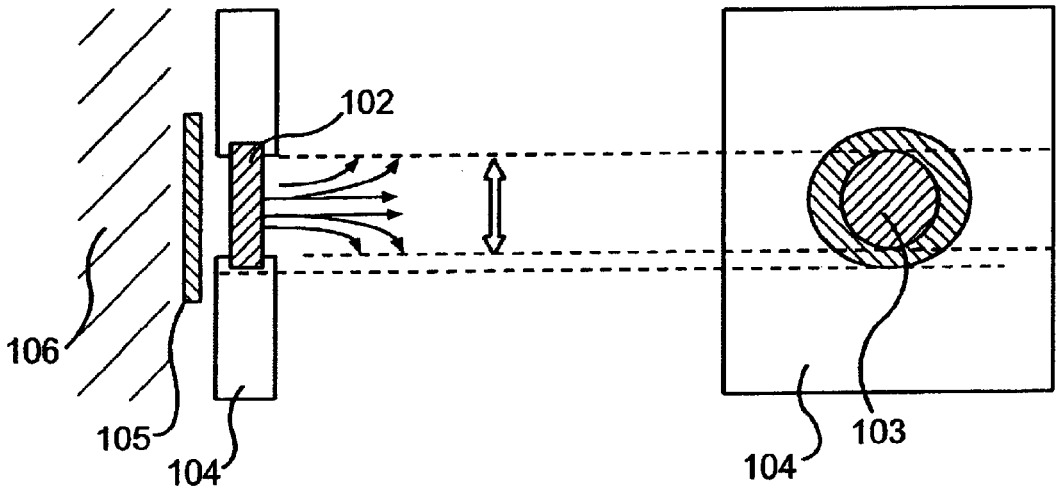

FIGS. 3*m* and 3*n* show a cross-sectional view of a rectangular or oval magnet on a support, which may be used with a device according to the invention.

Figure 3O:
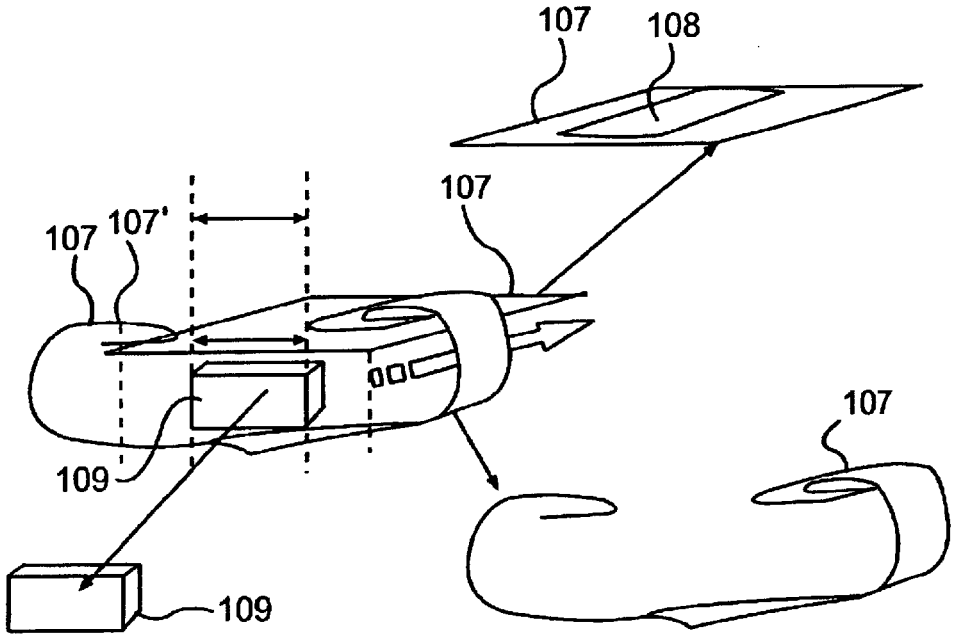
Figure 3P:
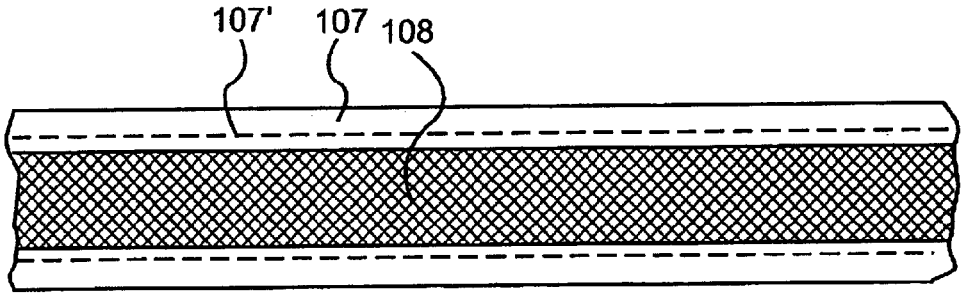

FIGS. 3*o* and 3*p* show perspective and cross-sectional views of an element of the device according to the invention comprising a fabric sheath with a strip of ferromagnetic cloth.

Figure 3Q:
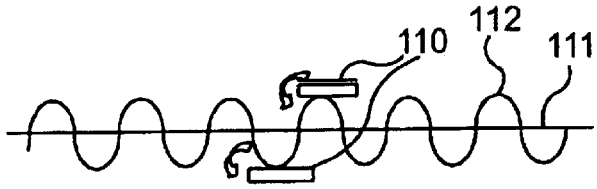

FIGS. 3*q,* 3*r* and 3*s* show cross-sectional and front views of a variant of sheath containing ferroconducting wire which may be used with the invention.

Figure 4A:
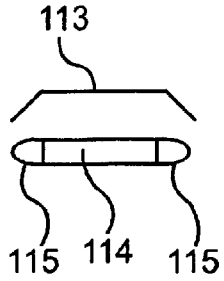
Figure 4B:
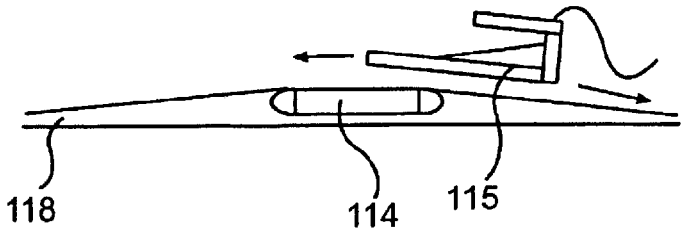
Figure 4C:
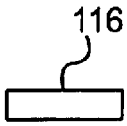
Figure 4D:
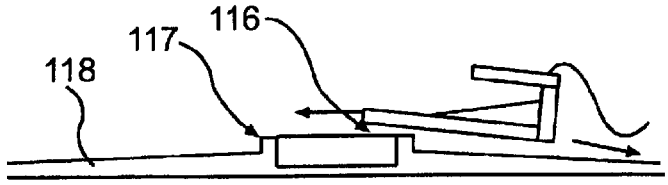

FIGS. 4*a* and 4*b* show a cross-sectional, schematic view of another embodiment of a magnet or ferromagnetic element, which may be used according to the invention, thus avoiding the ironing marks which would be produced with the magnet in FIGS. 4*c* and 4*d.*

Figure 5A:
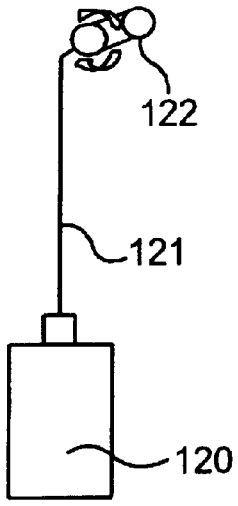

FIGS. 5*a,* 5*b,* 5*c* and 5*d* show motorised variants according to other embodiments of the invention.

Figure 5B:
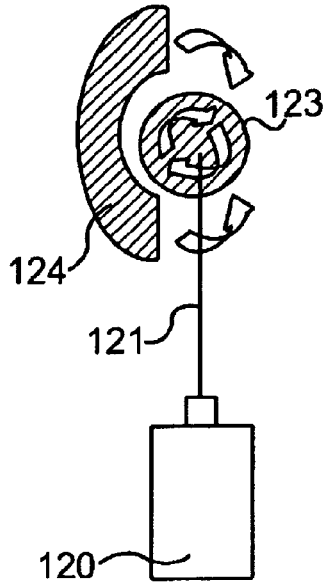
Figure 5C:
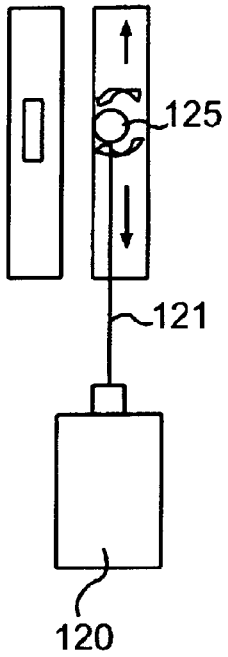
Figure 5D:
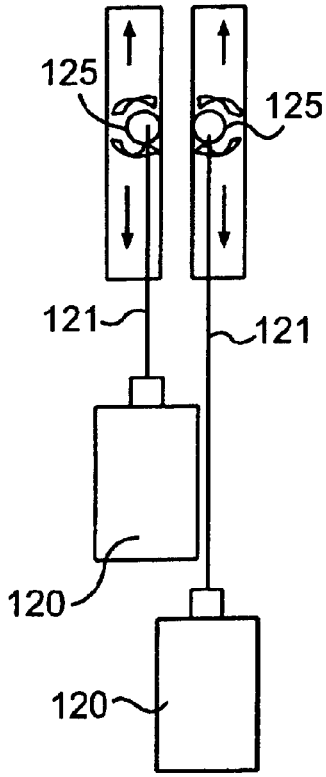
Figure 5E:
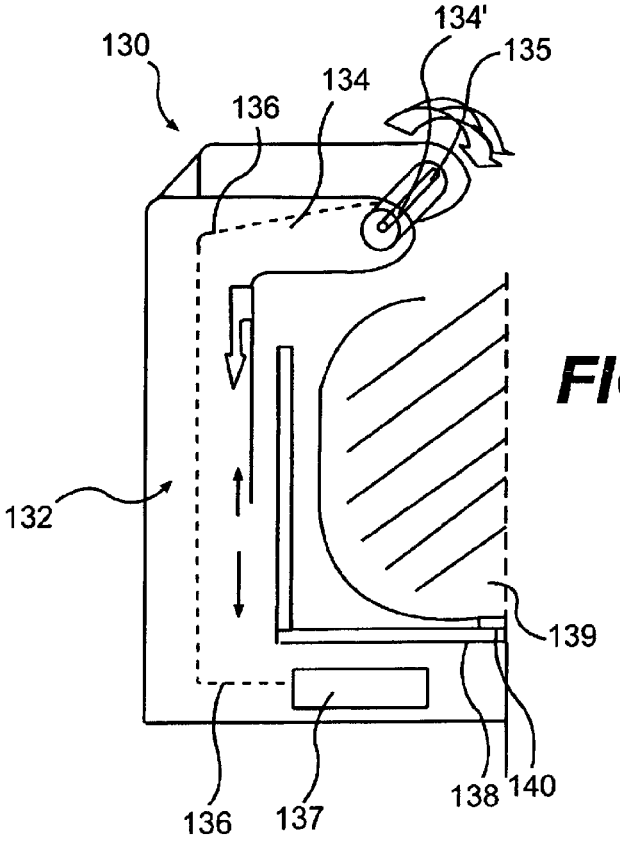
Figure 5F:
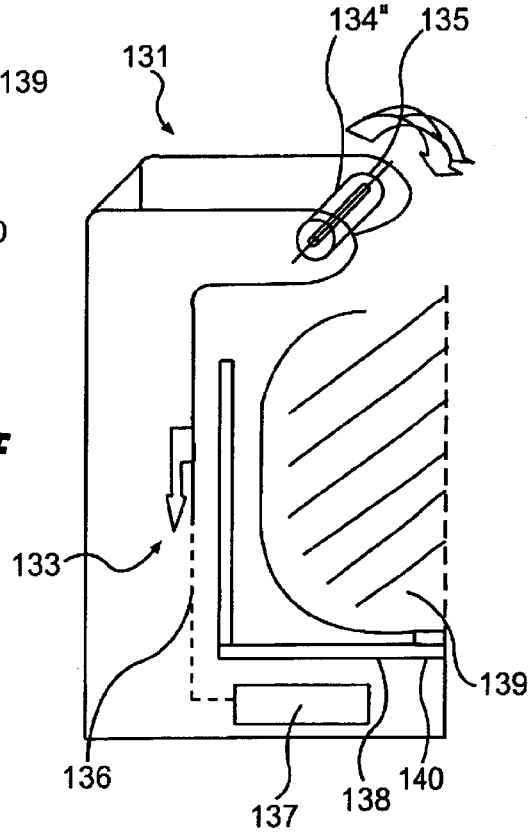

FIGS. 5*e* and 5*f* show schematic and cross-sectional views of shoes fitted with a device according to the invention, in which the wall of the shoe is pulled inwards.

Figure 6A:
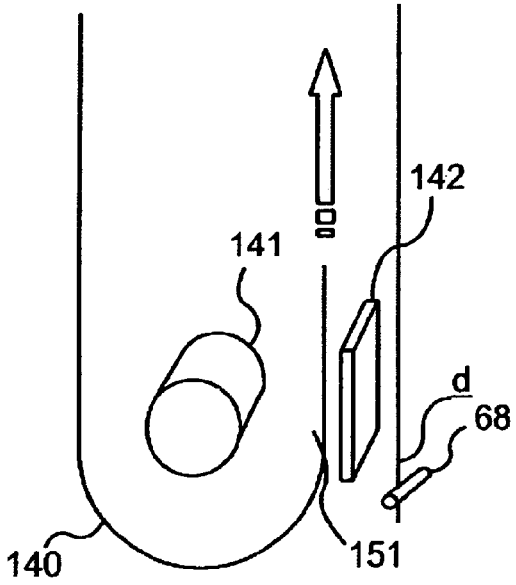

FIGS. 6*a,* 6*b* and 6*c* are schematic, cross-sectional and perspective views showing the principles for adjusting the hem of trousers, jackets, skirts or other clothing according to a specific embodiment of the invention.

Figure 6B:
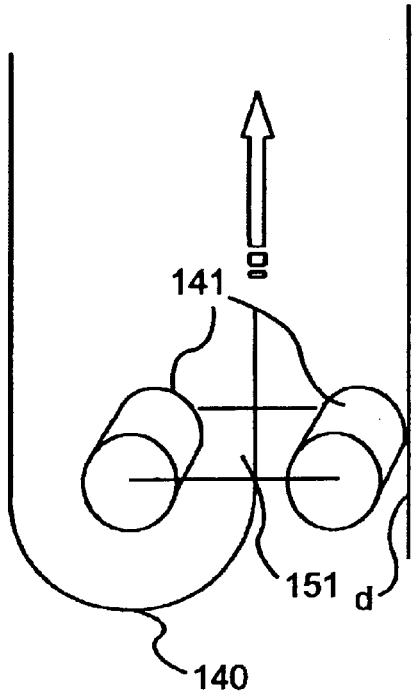
Figure 6C:
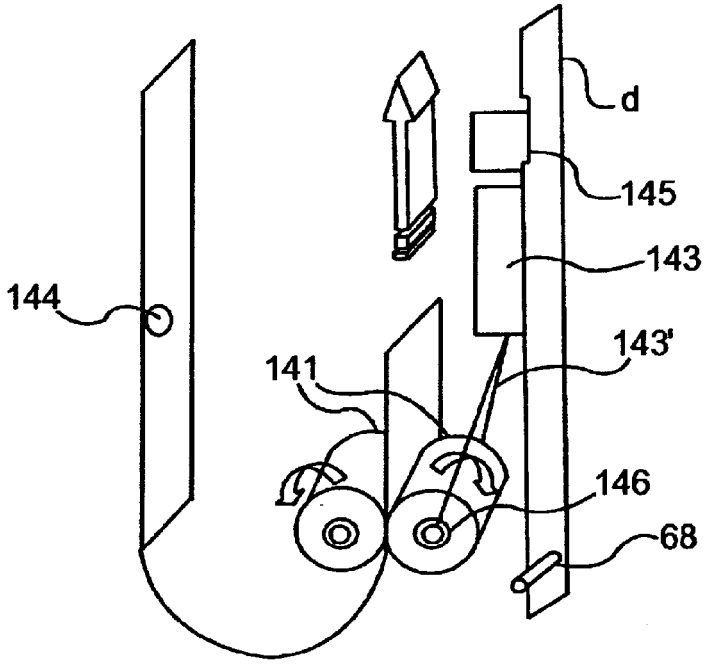
Figure 6D:
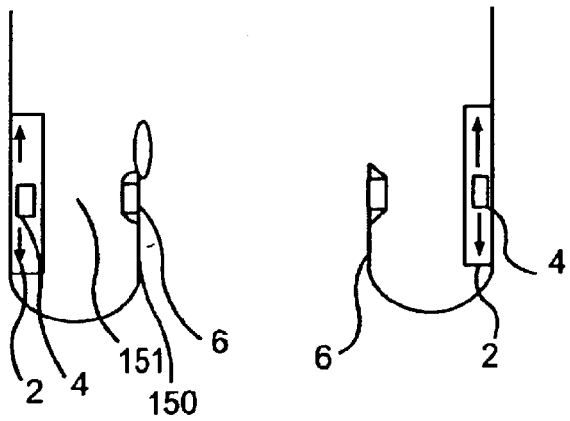
Figure 6E:
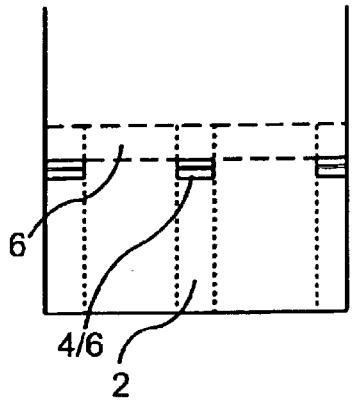
Figure 6F:
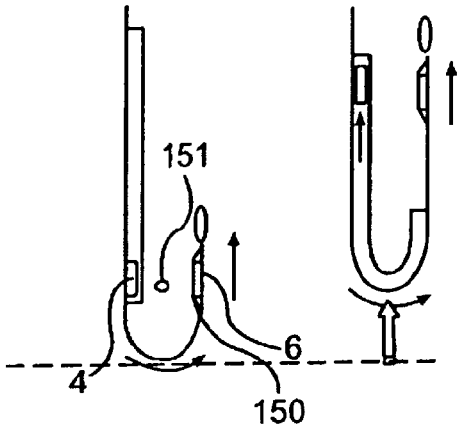
Figure 6G:
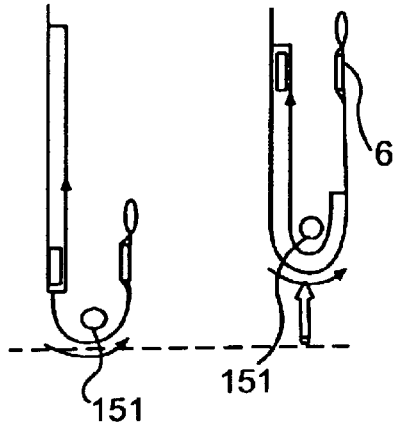

FIGS. 6*d,* 6*e,* 6*f* and 6*g* show cross-sectional and front views of another principle of hem adjustment using the invention.

Figure 7A:
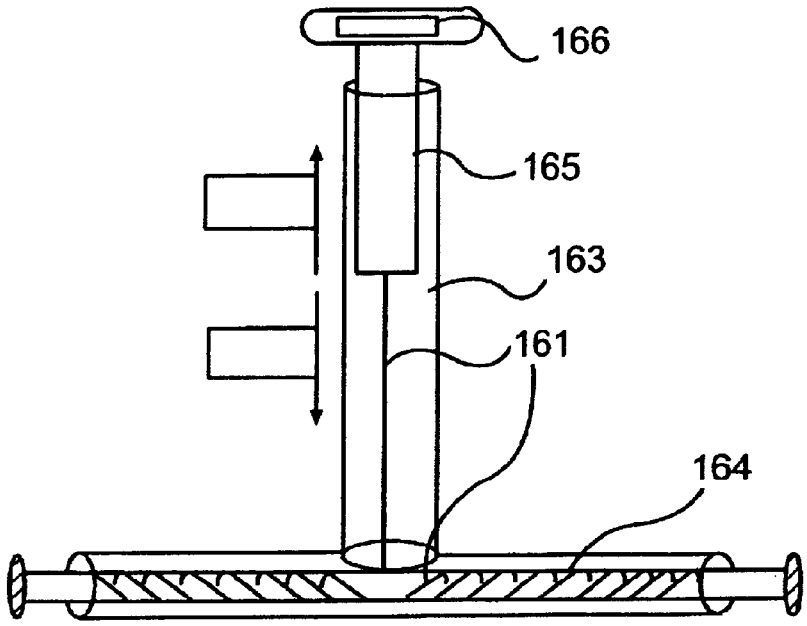

FIGS. 7*a,* 7*b* and 7*c* are cross-sectional drawings showing fastening through elastic tightening, using other embodiments of the invention.

Figure 7B:
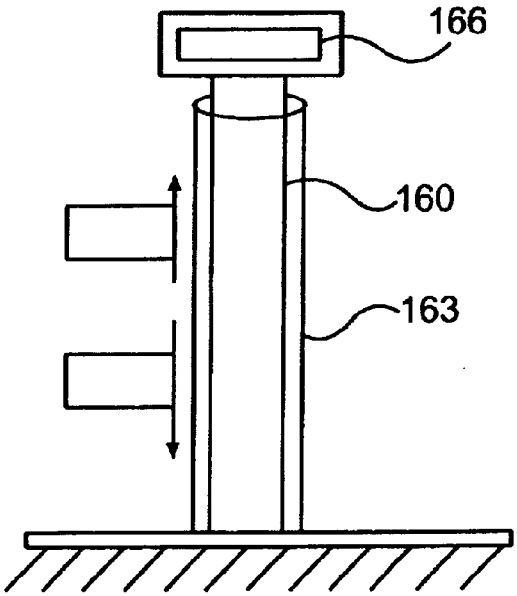
Figure 7C:
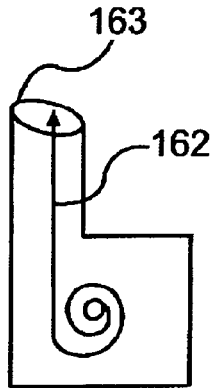
Figure 7D:
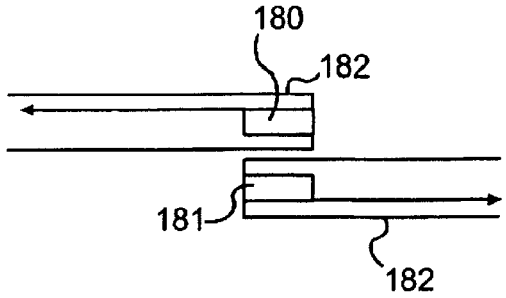

FIGS. 7*d,* 7*e,* 7*f,* 7*g* and 7*h* show schematically other principles of traction of a magnet or ferromagnetic element in the sheath, which are applied in certain embodiments of the invention.

Figure 7E:
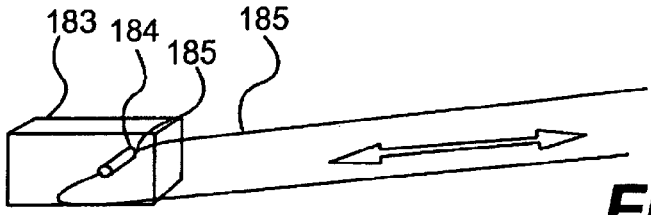
Figure 7F:
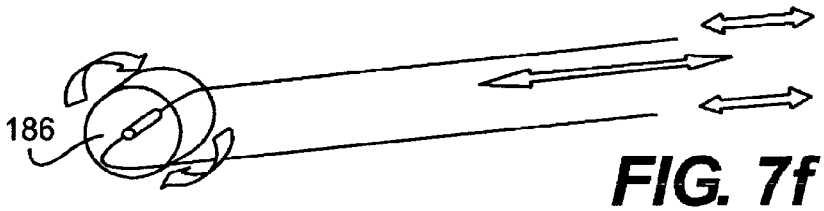
Figure 7G:
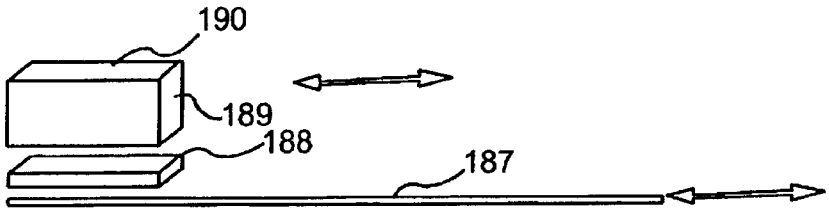
Figure 7H:
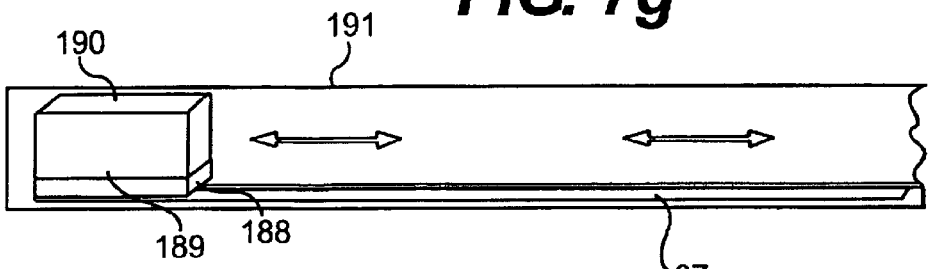
Figure 7I:
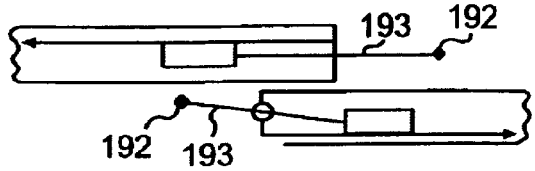
Figure 7J:
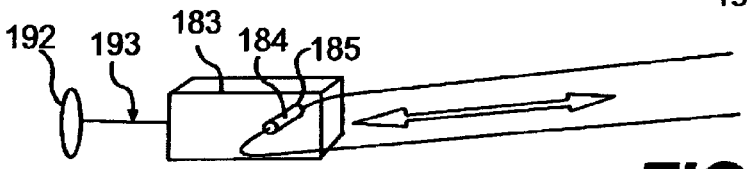
Figure 7K:
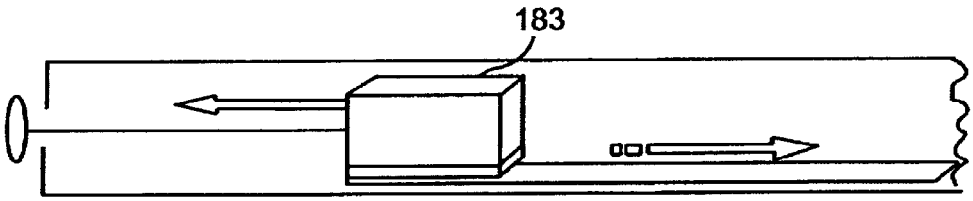
Figure 7L:
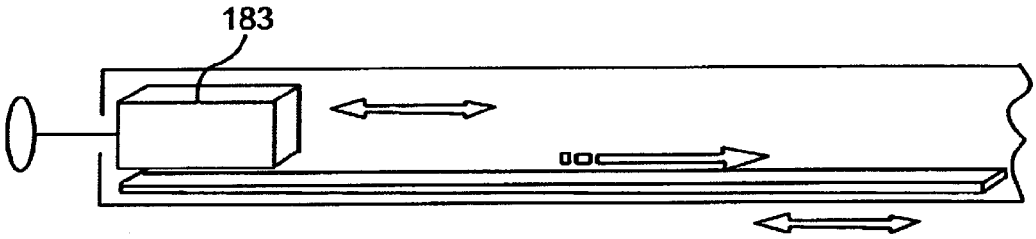

FIGS. 7*i,* 7*j,* 7*k,* 7*l* and 7*m* show principles identical to those shown in reference to FIGS. 7*d,* 7*e,* 7*f,* 7*g* and 7*h,* traction being here provided by a tab and/or cable.

Figure 7M:
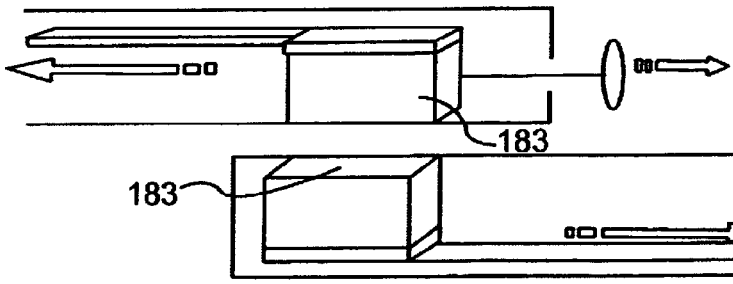

FIGS. 7*m,* 7*n* and 7*o* show other examples of traction systems and systems used to hold the magnet in the sheath.

FIGS. 7*p,* 7*q,* 7*r* and 7*s* give other examples of traction of the magnet or ferromagnetic element which may be used with the invention.

Figure 8A:
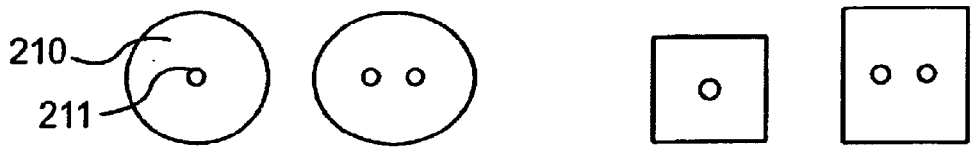
Figure 8B:
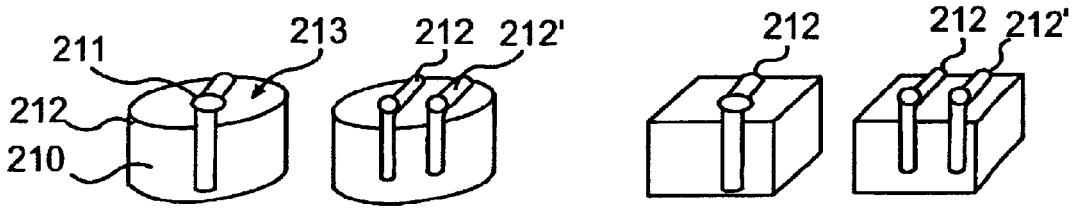
Figure 8C:
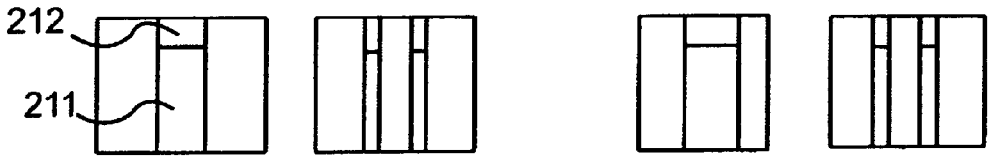
Figure 8D:
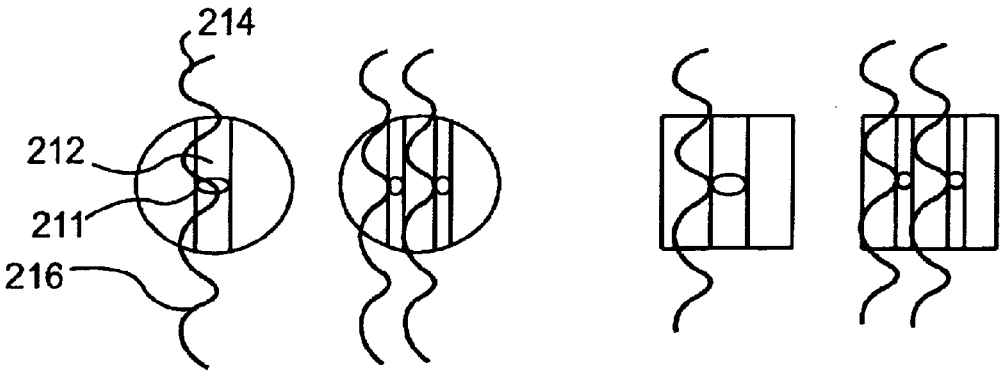
Figure 8E:
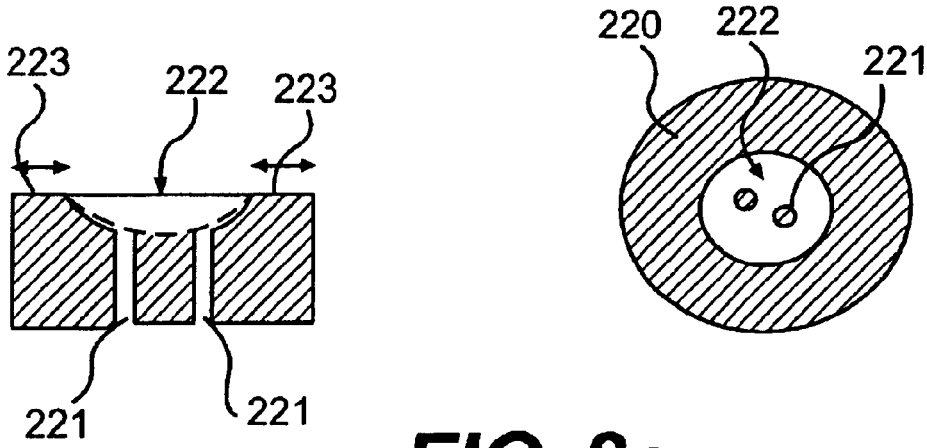
Figure 8F:
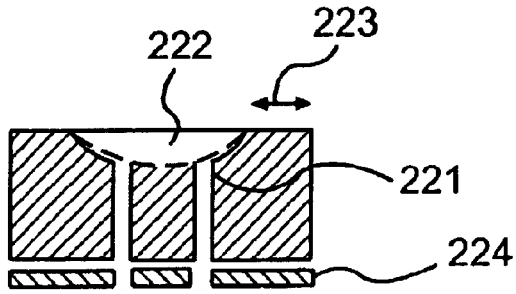
Figure 8G:
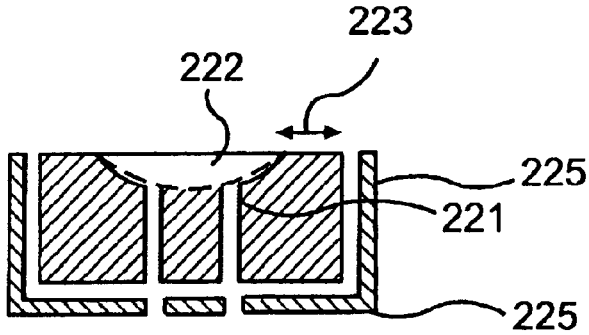
Figure 8H:
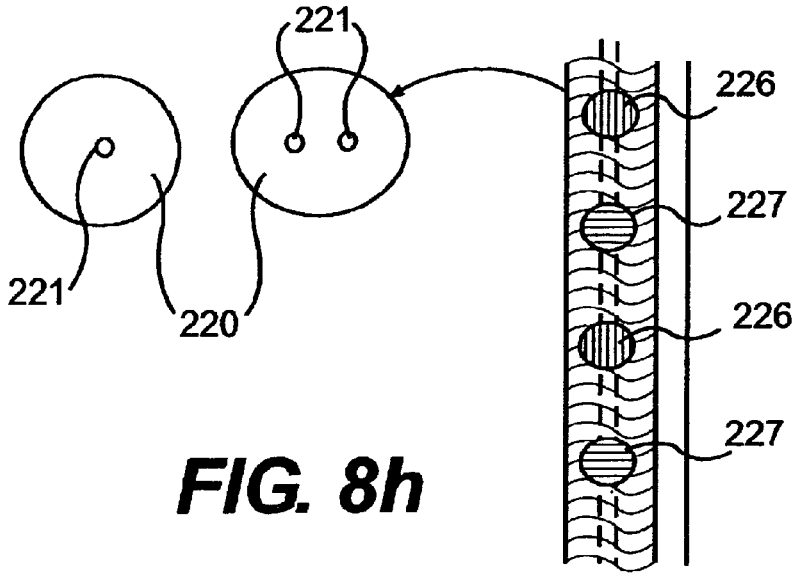
Figure 8I:
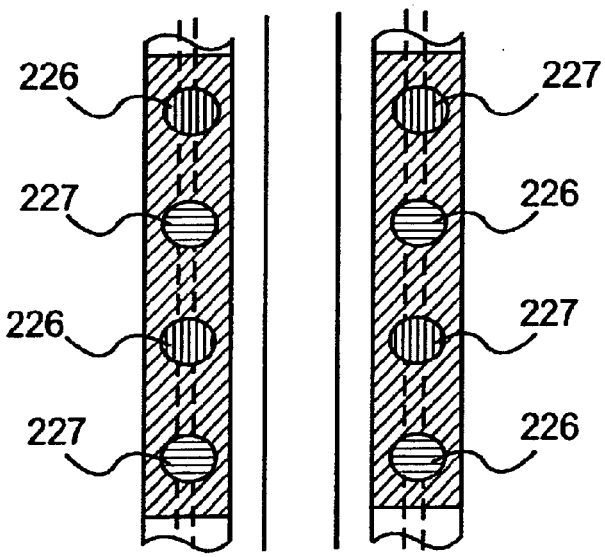

FIGS. 8*a,* 8*b,* 8*c,* 8*d,* 8*e,* 8*f* and 8*g* show the forms of magnets designed to be stitched onto clothing, which in particular may be used with the aforementioned attachment methods or with other attachment methods, as described in reference to FIGS. 8*h,* 8*i* and 8*j.*

Figure 8J:
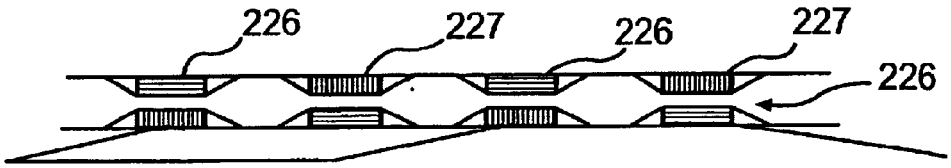
Figure 8O:
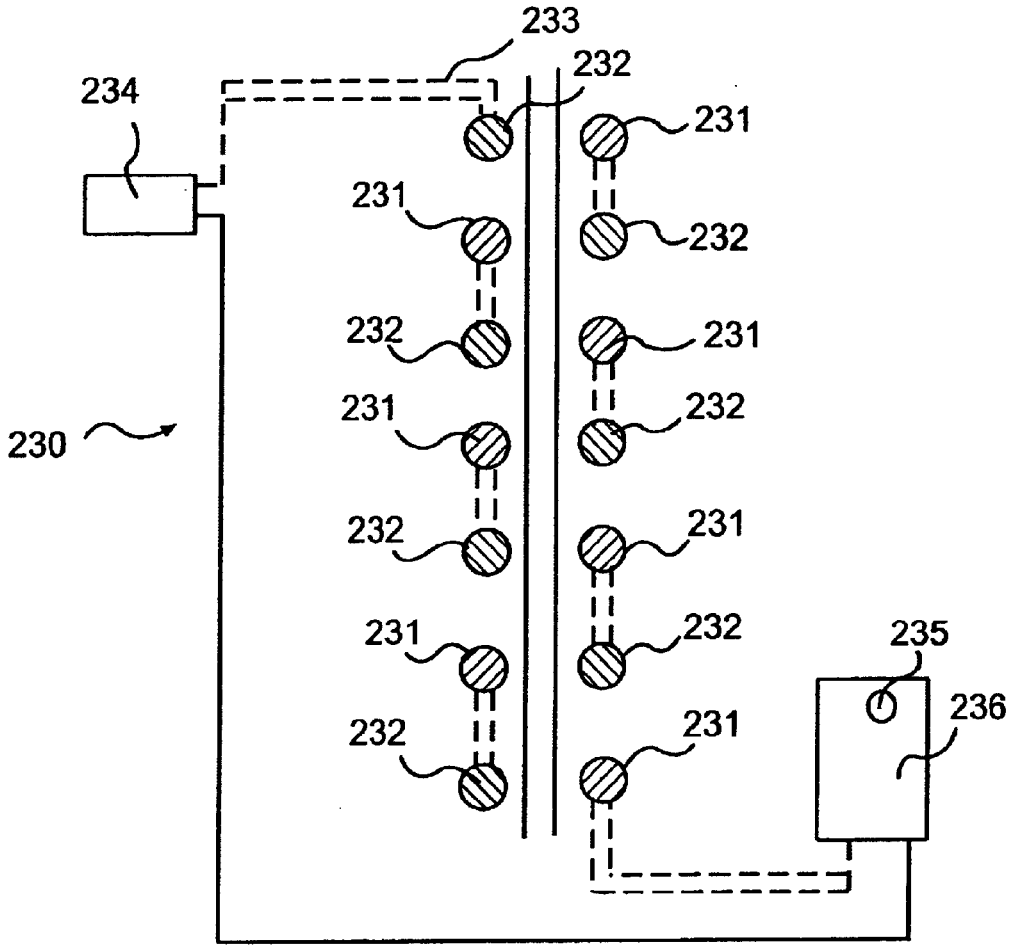
Figure 8P:
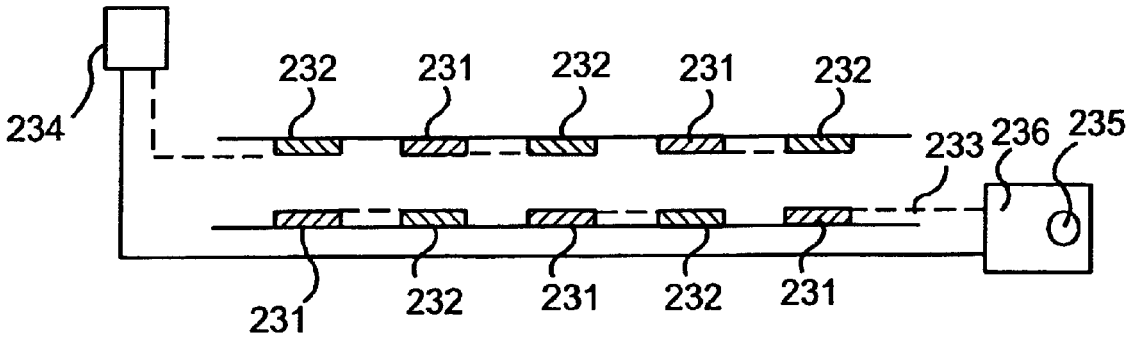

FIGS. 8*o* and 8*p* show schematically an example of an arrangement of magnets with alternating north and south faces which may be used with an alarm circuit capable of detecting when an item is incorrectly fastened.

Figure 8Q:
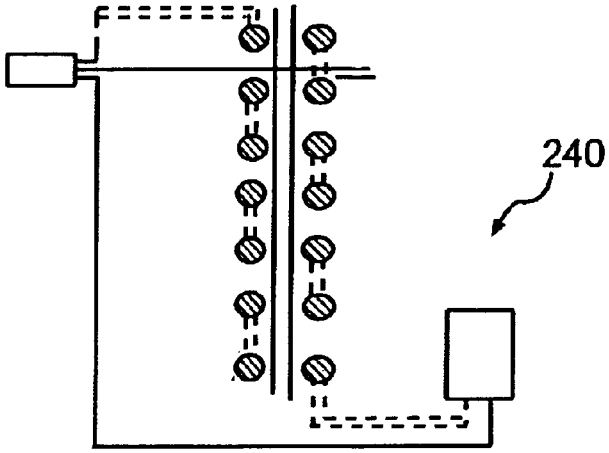
Figure 8R:
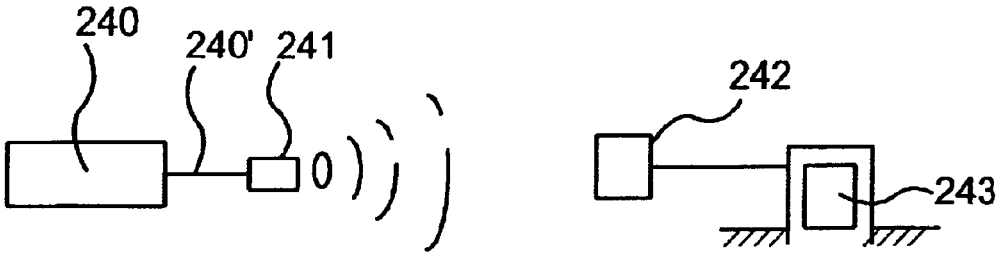
Figure 8S:
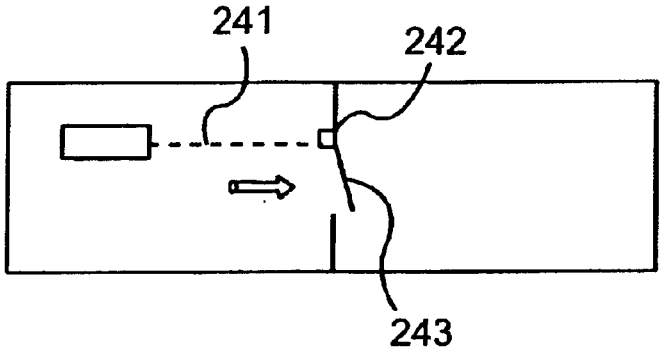

FIGS. 8*q,* 8*r* and 8*s* give another embodiment of a device which may be used with a remote control system to authorise moving from one room to another.

Figure 8T:
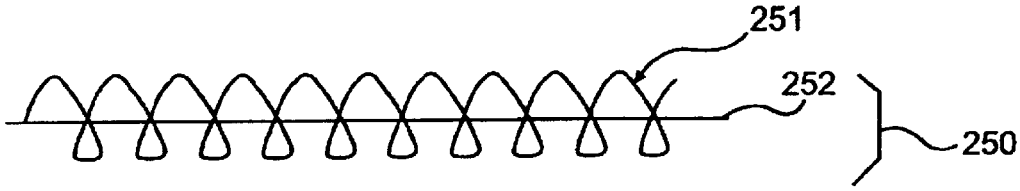
Figure 8U:
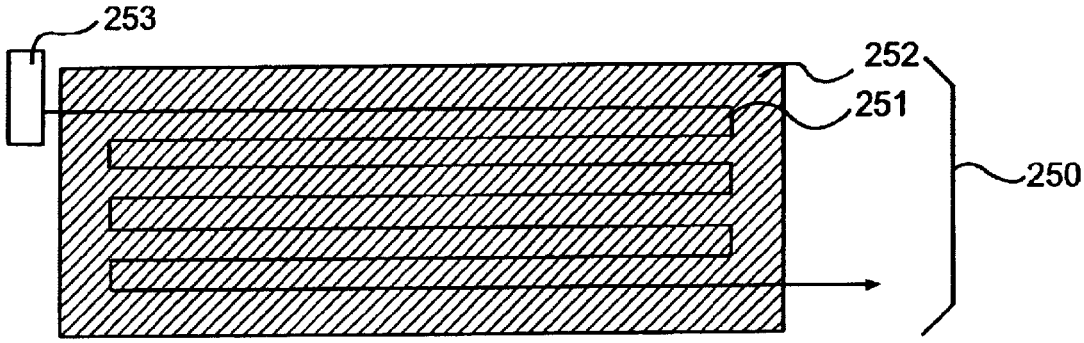
Figure 8V:
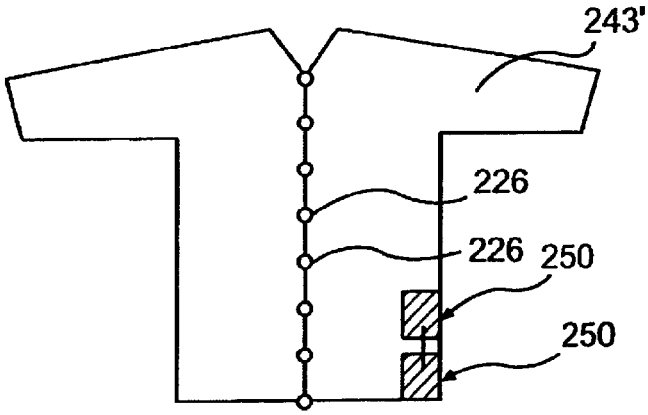

FIGS. 8*t,* 8*u* and 8*v* show a wiring arrangement, and an item of clothing which may be used with a device guaranteeing total sealing.

Figure 9A:
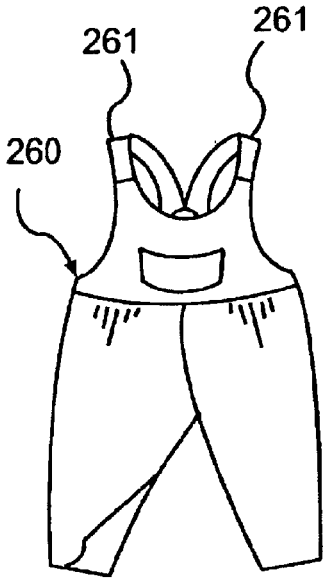

FIGS. 9*a,* 9*b* and 9*c* show perspective and schematic views of overalls with braces and the embodiments of its fastenings.

Figure 10:
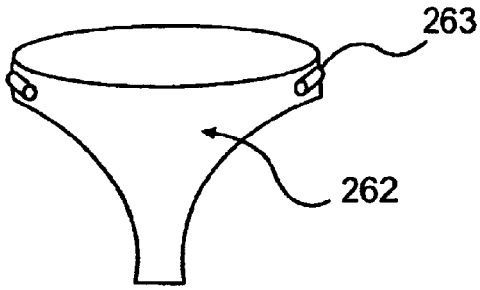

FIG. 10 shows underwear also using a device according to an embodiment of the invention.

Figure 11A:
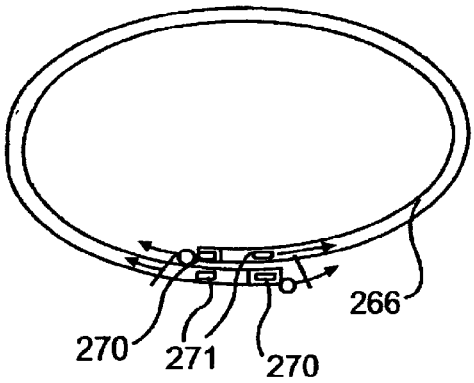
Figure 11B:
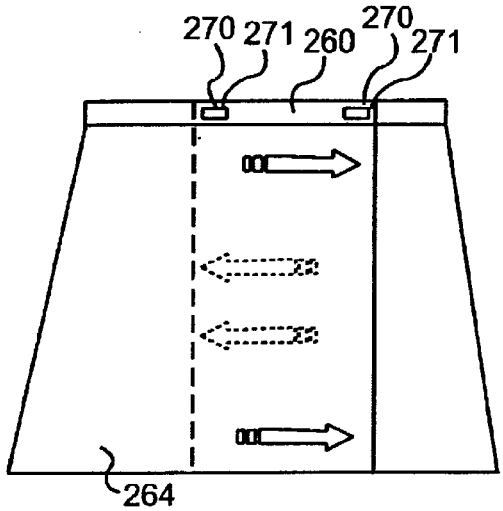
Figure 11C:
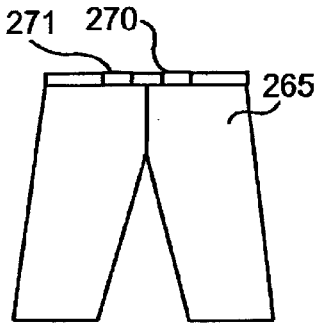

FIGS. 11*a,* 11*b* and 11*c* show top and perspective views of an embodiment of a skirt or trouser belt using a device according to the invention.

Figure 11D:
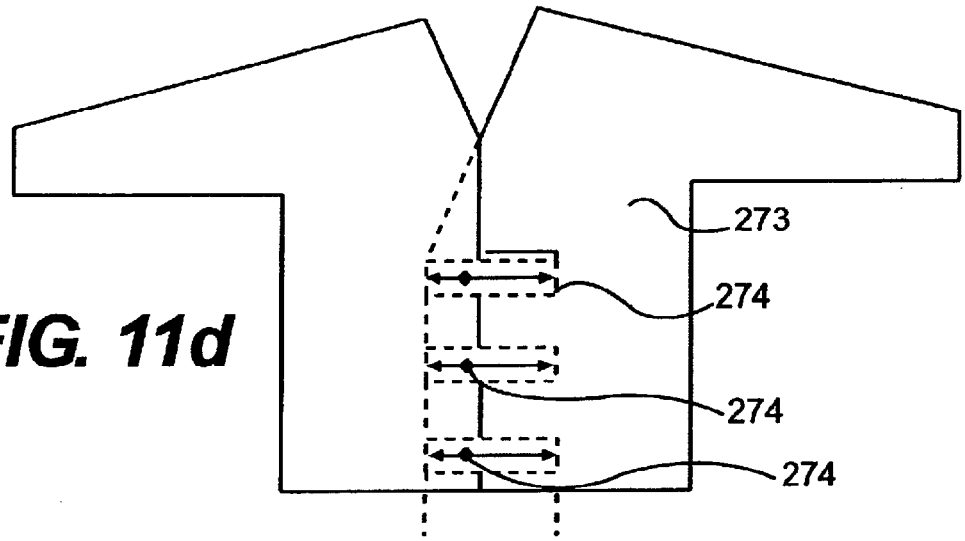
Figure 11E:
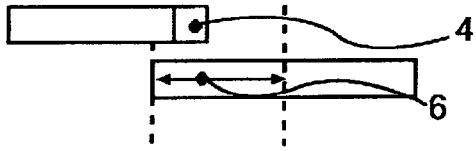
Figure 11F:
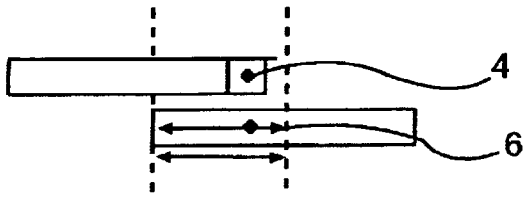

FIGS. 11*d,* 11*e* and 11*f* show front and cross-sectional views of a sleeved garment with an adjustment belt according to the invention, showing its operation.

Figure 11G:
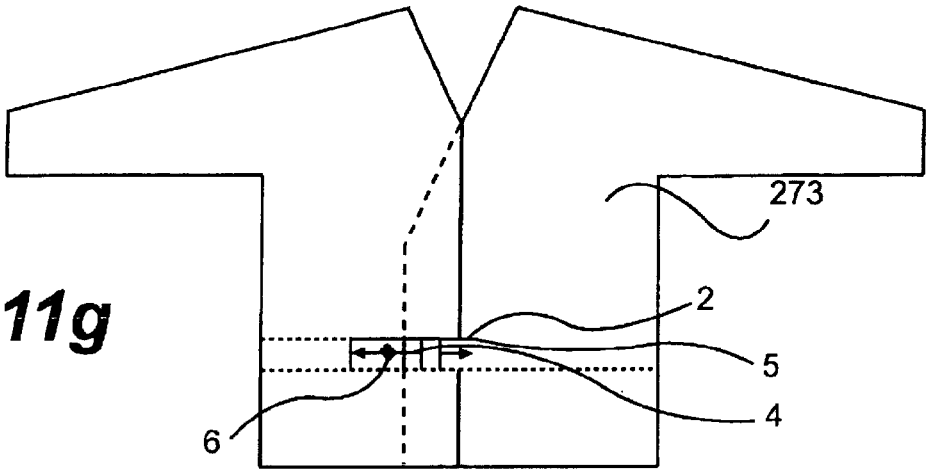
Figure 11H:
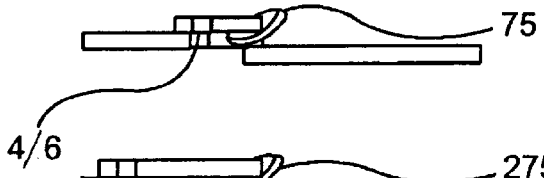
Figure 11I:
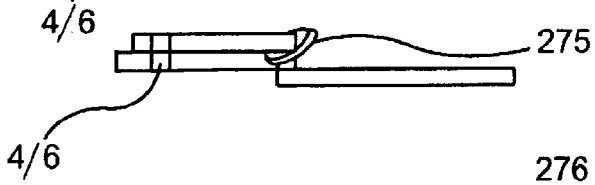
Figure 11J:
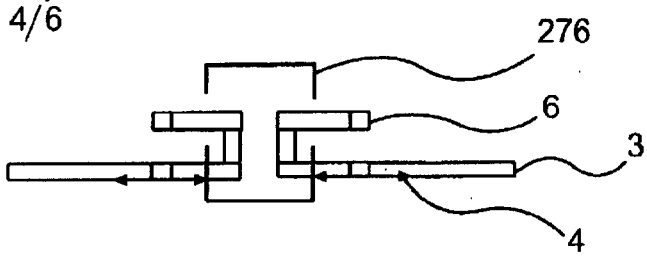
Figure 11K:
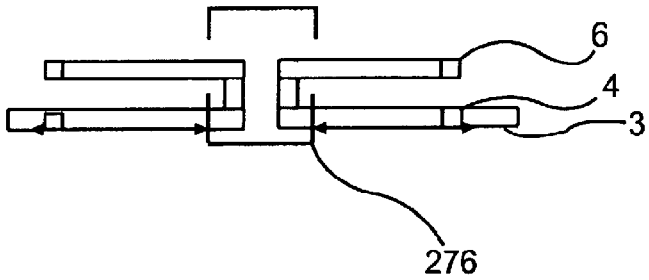

FIGS. 11*g,* 11*h,* 11*i,* 11*j* and 11*k* show a jacket and a cross-sectional view of an adjustment belt which may be used according to the invention.

Figure 11L:
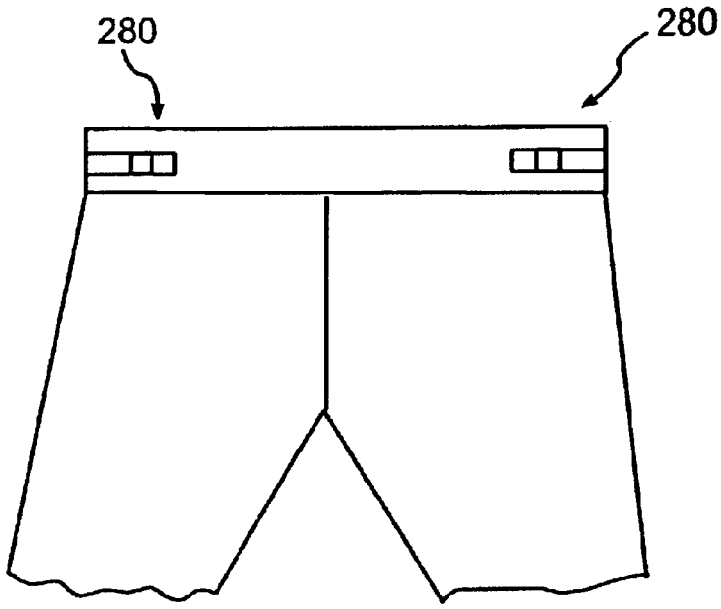

FIGS. 11*l,* 11*m* and 11*n* show a device applied to trousers, with front, side and cross-sectional views.

Figure 12A:
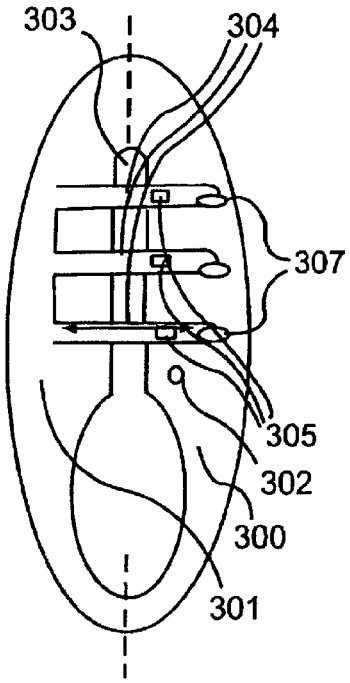

FIGS. 12*a,* 12*b,* 12*c* and 12*d* show top, cross-sectional and side views of a shoe with an adjustable device according to several embodiments of the invention.

Figure 13A:
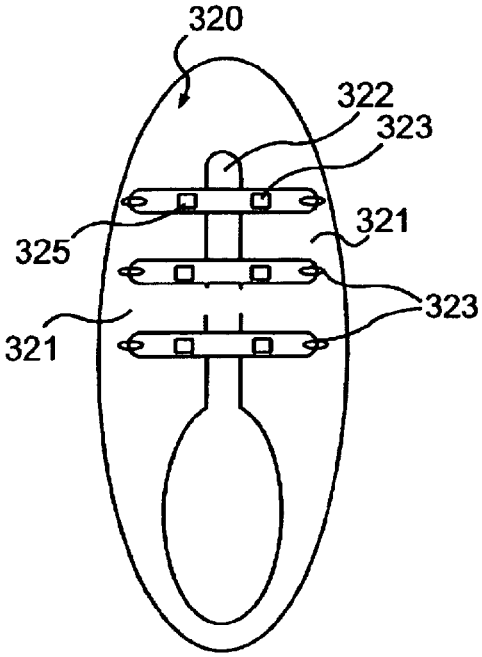

FIGS. 13*a,* 13*b,* 13*c* and 13*d* show top and cross-sectional views of two other embodiments of the invention.

Figure 14A:
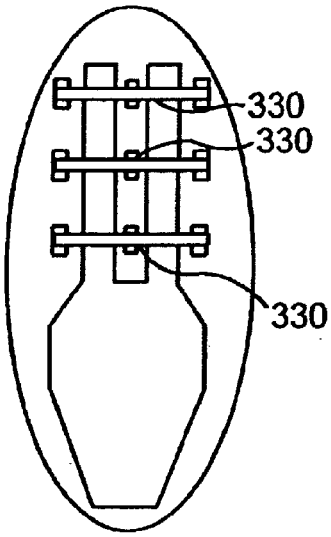
Figure 14B:
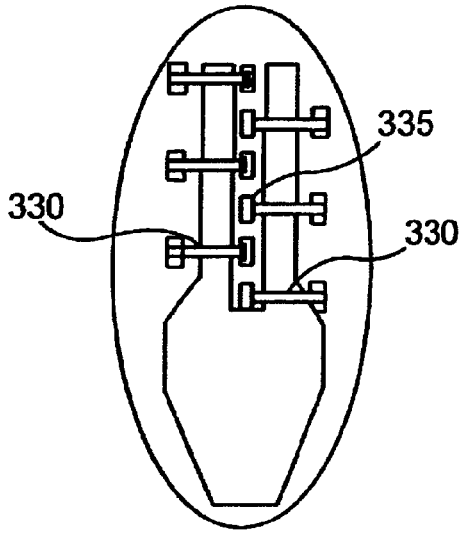
Figure 14C:
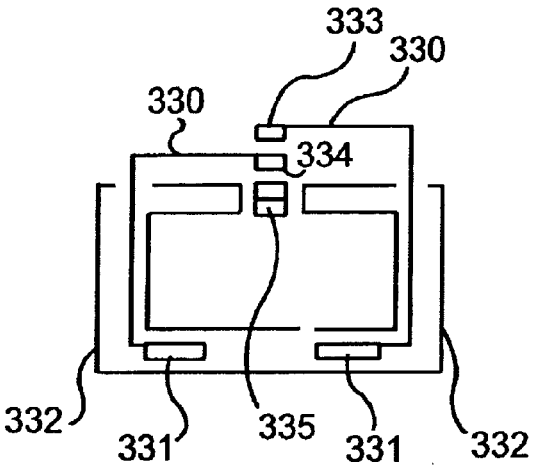
Figure 14D:
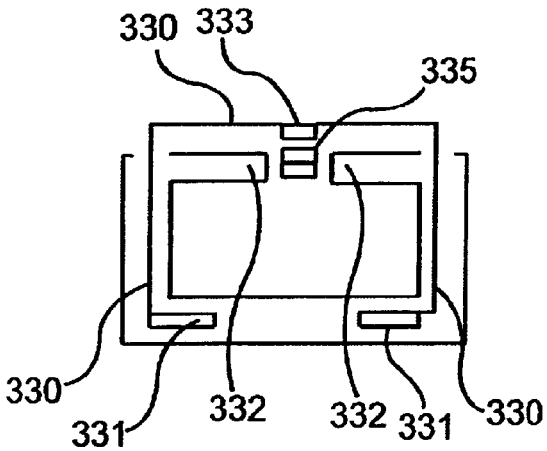

FIGS. 14*a,* 14*b,* 14*c* and 14*d* show top and cross-sectional views of two other embodiments of shoes according to the invention.

Figure 15A:
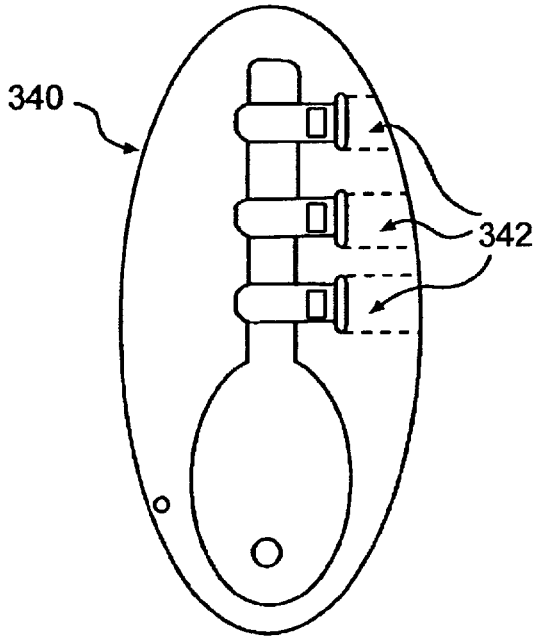
Figure 15B:
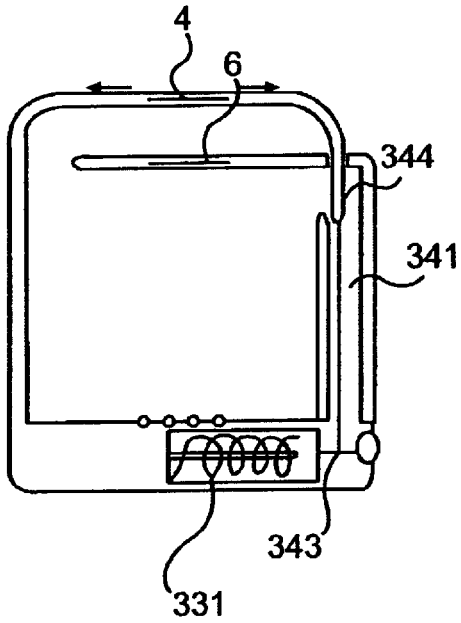

FIGS. 15*a* and 15*b* show top and cross-sectional views of another embodiment of a shoe according to the invention with an automatic adjustment device.

Figure 16A:
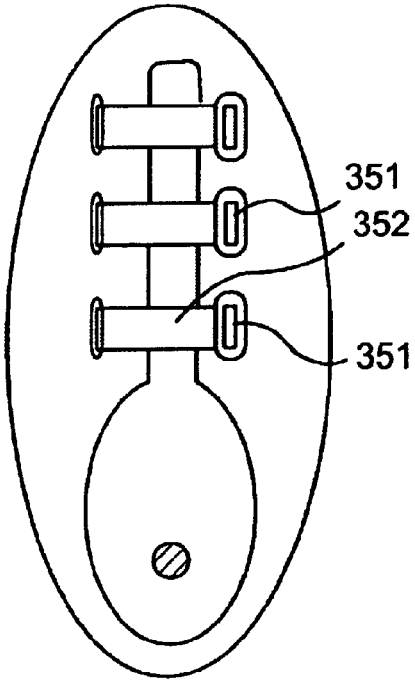

FIGS. 16*a,* 16*b,* 16*c* and 16*d* show top and cross-sectional views of two other embodiments of a shoe according to the invention with an automatically adjustable device.

Figure 17A:
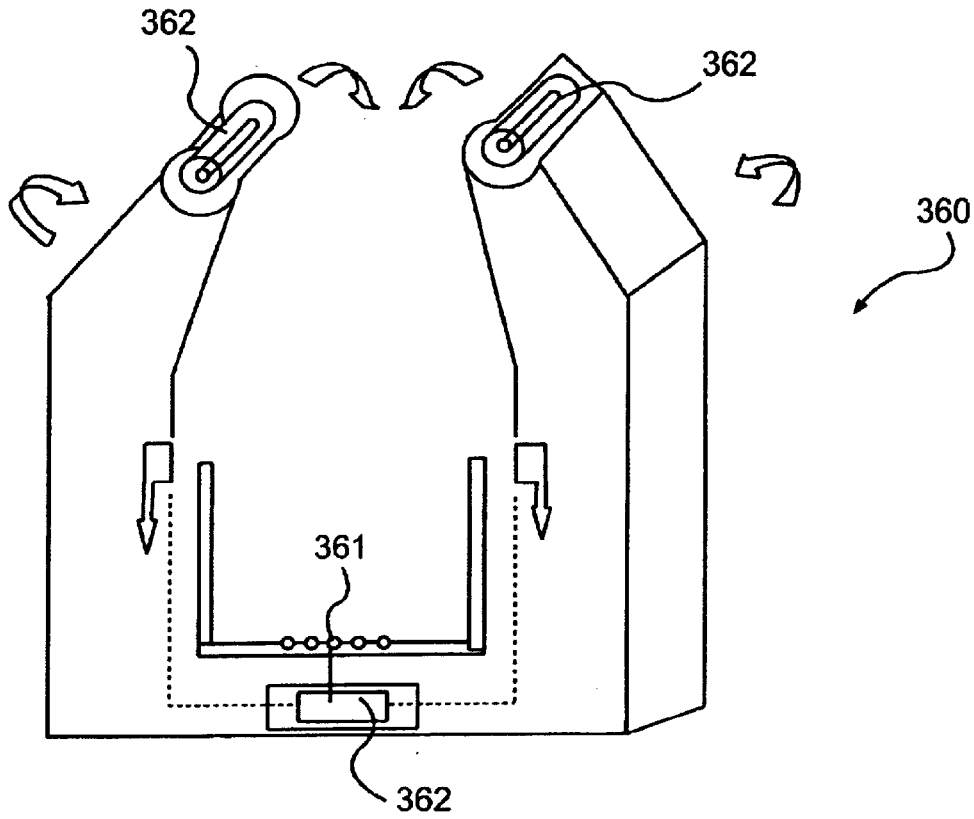
Figure 17B:
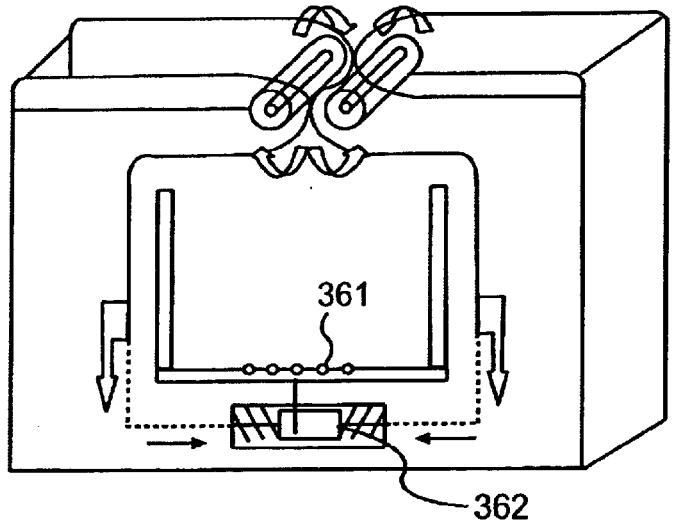

FIGS. 17*a* and 17*b* show schematic and perspective views of an application for shoes of the principle presented in reference to FIG. 6*b.*

Figure 17C:
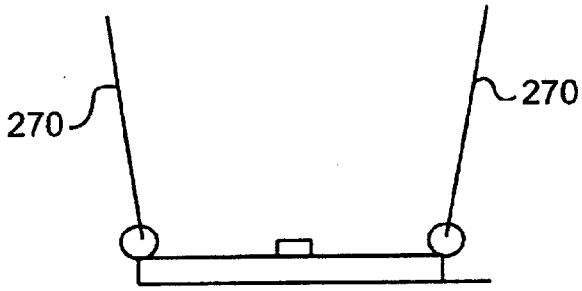
Figure 17D:
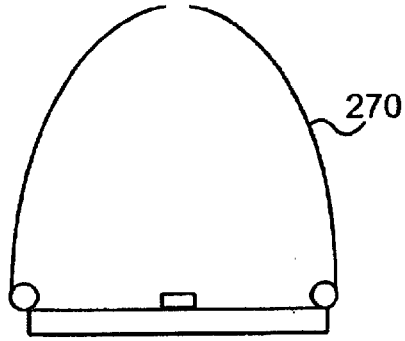
Figure 17E:
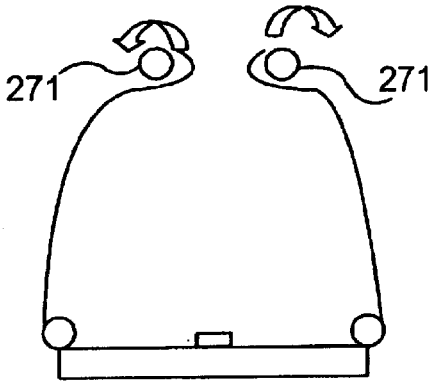

FIGS. 17*c,* 17*d,* 17*e,* 17*f,* 17*h* and 17*i* show top and cross-sectional views of other embodiments of this principle.

Figures 18A, 18B, 18C:
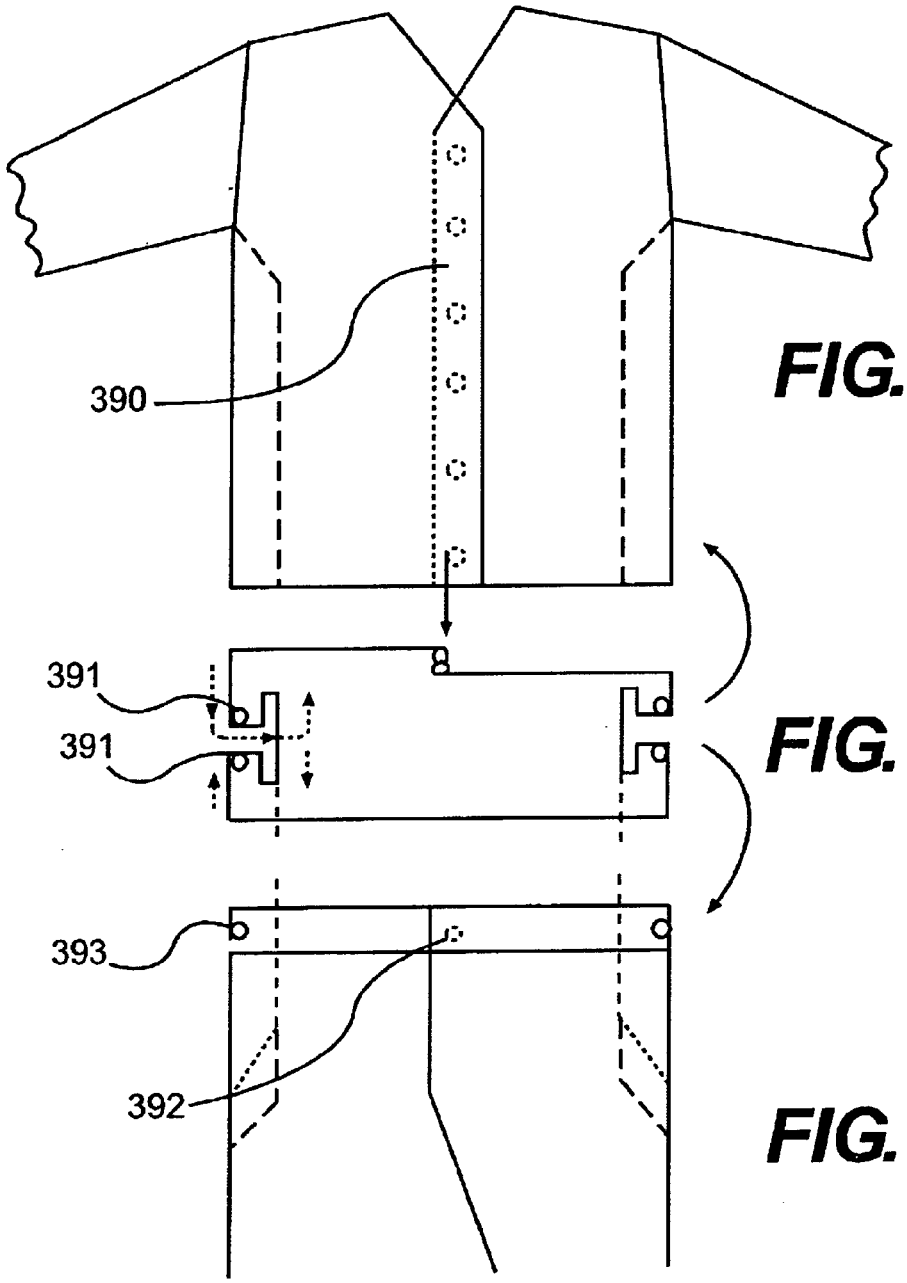

FIGS. 18*a,* 18*b* and 18*c* show a whole outfit with horizontal adjustment.

Figure 19A:
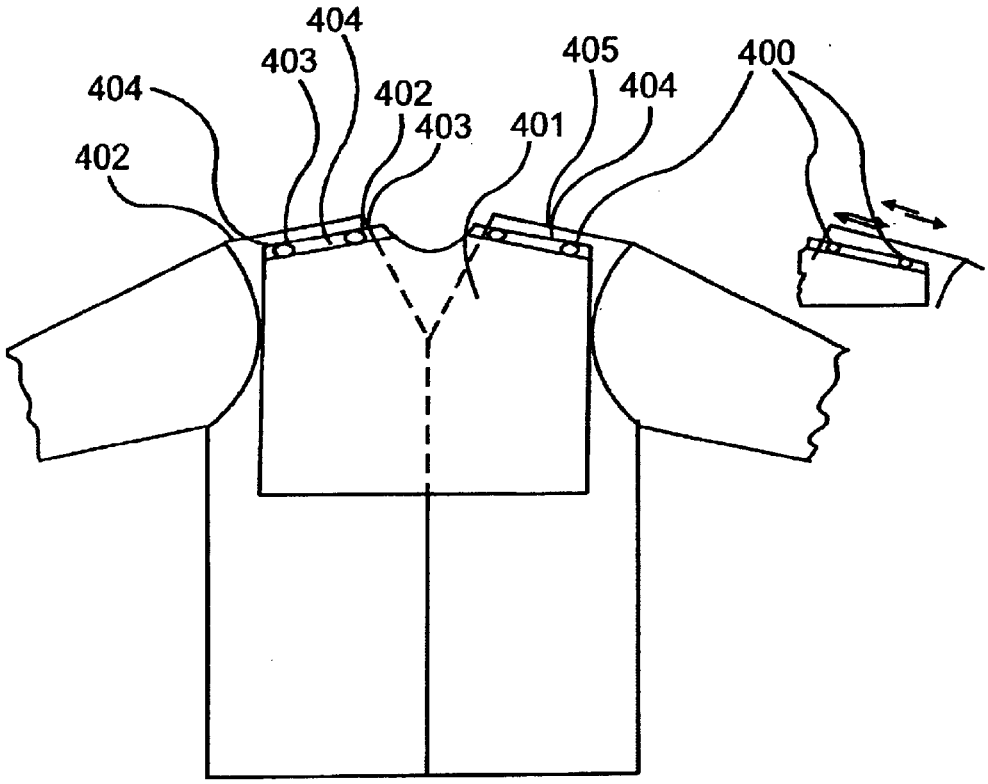
Figure 19B:
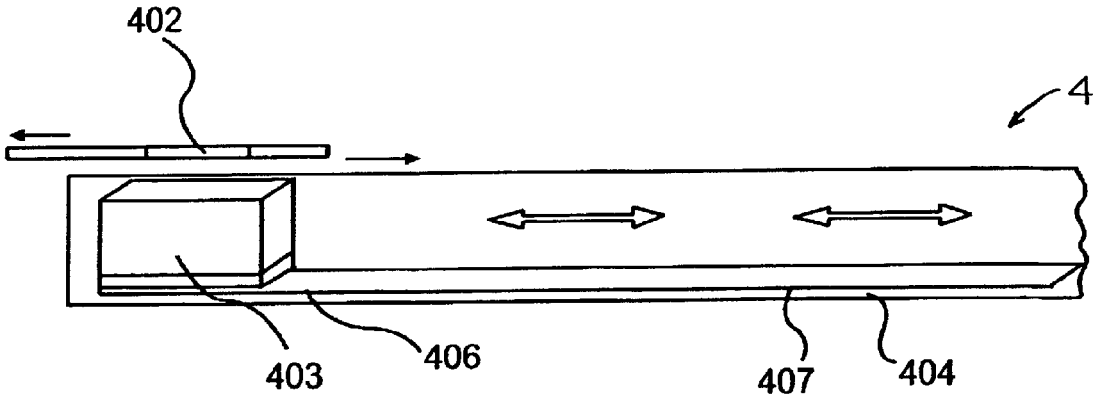

FIGS. 19*a* and 19*b* show a doctor's or dentist's coat with a detachable bib and adjustment device.

In what follows, if possible the same reference numbers will be used to designate the same elements or similar elements.

The magnets used in the embodiments of the invention more specifically described here are preferably based on compressed Neodymium Iron Boron of 7.3 to 7.5 g/cm3 density, the coating of the magnet being obtained through a nickel and copper-based alloy.

One of the difficulties encountered in this invention was being able to guarantee the correct operation of the magnets over time.

Taking into account the ageing of magnets when they are subject to high temperatures and repeated washing, this ageing gradually tending to an asymptotic limit, it is therefore preferable to use aged magnets.

FIG. 1*a* shows a device 1 for holding together, adjusting, fitting or fastening parts of a garment, shoe or any other accessory, containing a first part 2, comprising at least one sheath 3 in which is inserted a magnet known as the first magnet 4 which may be also a ferromagnetic element.

Magnet 4 is movable inside the sheath which is for example made up of a double strip of fabric 1 cm wide.

Device 1 also contains a second part 5 comprising a second magnet 6 or ferromagnetic element which can work in conjunction with the first magnet 4.

As shown by the arrows 7, the first magnet 4 which is narrower than the width of the sheath, can slide in the said sheath 3 between different positions, a multitude of adjustments or alterations being possible.

Figure 1B:
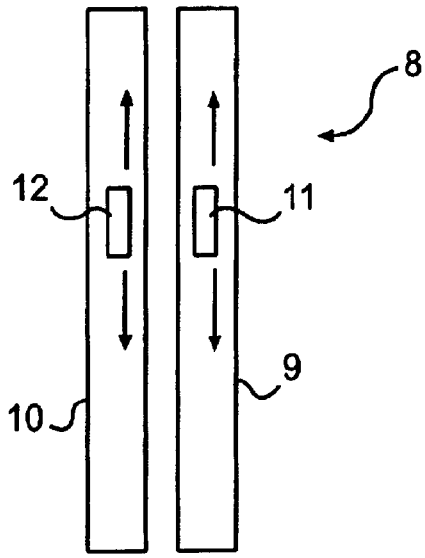

FIG. 1*b* shows a second embodiment of a device 8 according to the invention comprising two parallel sheathes 9 and 10, for example made up of fabric conduits or channels of the same width and of a longer length, the said conduits being arranged or likely to be arranged opposite each other when the device is used, to fasten or adjust two open parts of clothing.

These two sheathes 9 and 10 belong respectively to a first and second part of the device 8 to which they are fixed.

Sheathes 9 and 10 each have a ferromagnetic element 11 and 12 of which at least one is comprised of a magnet, the two elements being capable of working in conjunction with each other, allowing a double adjustment, which is for example preferable in certain embodiments such as belts for clothing.

Figure 1C:
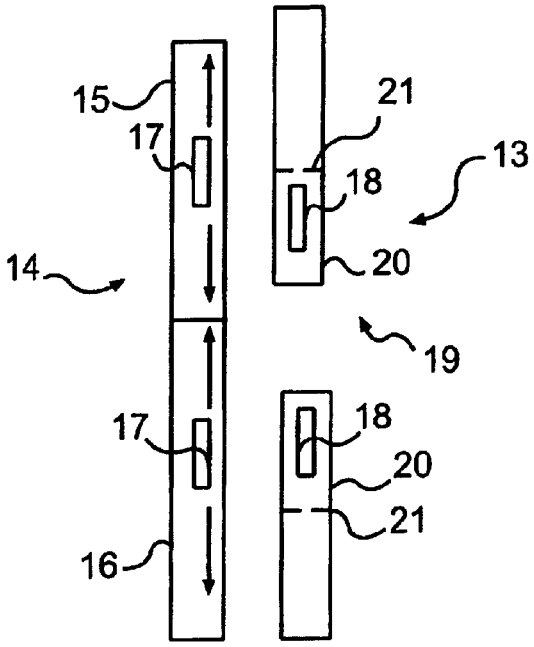

FIG. 1*c* shows a third embodiment of a device 13 according to the invention. Device 13 contains firstly part 14 comprising two sheathes 15 and 16 lying head to tail one against the other, each having two identical ferromagnetic elements or magnets 17, the said ferromagnetic elements being capable of working in conjunction with two magnets or ferromagnetic elements 18 belonging to a second part 19 of the device according to the invention.

In this example, the second part 19 is formed of two identical sleeves 20, for example made out of fabric, lying opposite and at a distance from each other, and fixed to one or more parts of the garment, it being possible to arrange them opposite the two sheathes 15 and 16 respectively.

The magnets or ferromagnetic elements 18 are fixed to them, for example by gluing and/or simply by being held in place at one end of the sleeve, for example with stitches 21.

Figure 1D:
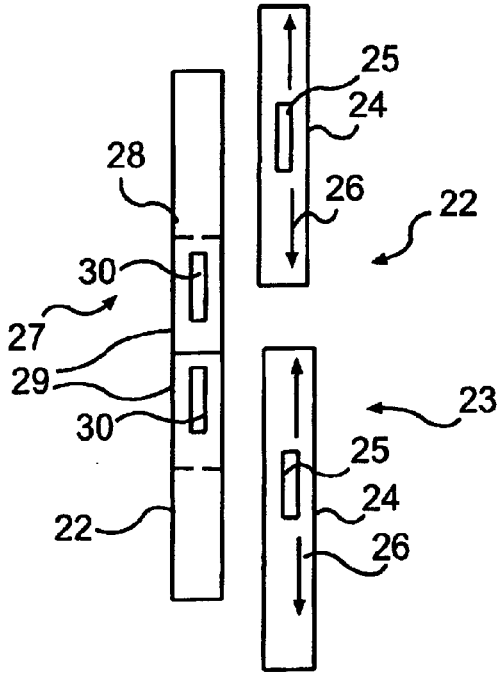

FIG. 1*d* shows another embodiment of a device 22 according to the invention comprising a first part 23 containing two identical movable sheathes 24 which each have two identical magnets 25, and move inside the sheath in the direction of the arrows 26.

Device 22 also comprises a second part 27, for example made up of a strip forming two sleeves 28 with two central parts 29, inside which two ferromagnetic elements 30 are held in place.

FIGS. 1*a* to 1*d* show that when the ferromagnetic elements and magnets are activated with each other and therefore held in place by an air-gap created by the single and/or double thicknesses of the sheathes or strips in which the said elements are located, the sheathes which are attached to one part of a garment, shoe or other accessory, can be moved with the said part of the garment in relation to the other part of the garment, this being attached to the second part, which will allow adjustment or alteration through the sliding of the first ferromagnetic element or magnet in the corresponding sheath(es).

In the embodiments represented in reference to FIGS. 1*a* to 1*d*, the magnets or ferromagnetic elements are symbolised cross-sectionally in the form of a rectangular plate.

FIG. 2*a* shows another device 31 comprising two elements 32 (ferromagnetic and magnet) of identical parallelepipedic shape, capable of working in conjunction with each other.

The elements 32 are longer than their width and/or thickness, for example more than five times, and in particular more than ten times longer.

FIG. 2*b* shows another embodiment 33 of two elements 34 and 35 capable of working in conjunction with each other, namely a ferromagnetic element 34 in the form of a partial cylinder or ovoid, with an internal orifice or internal recess 36 approximately circular in section, and a cylindrical magnet 35 on which the arrows 37 schematically show the direction of rotation of the magnet around an axis 38 perpendicular to the plane of the strip or sheath in which the magnet is going to move.

FIG. 2*c* shows a different device 39 according to the invention comprising a first sheath 40 fitted with a cylindrical magnet 41, which can rotate (arrow 42) and move in the said sheath 40, and a second part 43 fitted with a magnet 44 in the form of a parallelepipedic block capable of working in conjunction with the cylindrical magnet 41 when the latter is brought towards the said element 43.

FIG. 2*d* shows another embodiment of a device 45 according to the invention comprising two identical cylindrical magnets 41, capable of working in conjunction with each other and of turning one in relation to the other around their axis when these magnets are moved inside the two sheathes 46 placed opposite each other.

FIG. 2*e* is a schematic representation showing operation of an embodiment of the invention using the movement of the tab 47 in relation to the two cylindrical magnets 48 opposite each other which are therefore going to grip the thickness 49 of the tab, at least one of the elements 48 therefore moving inside the tab or sheath 49, the other element being capable of turning in relation to its support, for example a garment.

FIG. 2*f* shows another embodiment of a device 50 according to the invention comprising a double set of double tabs 51 opposite each other, each one having two cylindrical ferromagnetic elements or magnets 52 on either side of a longitudinal internal wall 53, the point 54 symbolising the point of magnetic contact between the two tabs 51, movable in relation to each other in the direction of the arrows 55.

FIG. 2*g* shows an enlarged view of an embodiment of a magnet/ferromagnetic element pairing which may be used with the invention, namely a cylindrical magnet 56 with a hollowed out central axis 57 and a flat, parallelepipedic ferromagnetic element 58, the two ferromagnetic elements being activated in relation to each other via an air-gap field 59 created by the thickness of the casing 60 of the fabric sheath.

FIG. 2*h* shows a schematic embodiment of a magnet 61 to which a return spring 62 is attached, making it possible to bring the magnet back to a preset position, the said spring being for example attached to one of the ends of the sheath in which the magnet 61 is moved.

FIG. 2*i* shows another embodiment of a magnet/ferromagnetic element pairing with a stretched elastic return thread 63.

FIGS. 2*j* and 2*k* show another embodiment of a ferromagnetic element/magnet pairing, containing two cylindrical magnets 64 held in place in relation to each other via an axis for example in plastic material 65 and containing between the said magnets a helical spring 66 allowing the relative movement of the two magnets in relation to each other and with respect to their cylindrical axial support 65, the magnets 64 being arranged to work in conjunction with the ferromagnetic elements 58 located on either side of them on a second fixed part, the spring 66 allowing movement of the magnets 64 in the sheath, one of the said magnets 64 also being for example attached to the said sheath and the other magnet being movable, this allowing the "gathering" of the sheath concerned.

FIGS. 2*l* and 2*m* show another embodiment of a magnet or ferromagnetic element 67 according to the invention containing in this example two hinged magnets or ferromagnetic elements 68 and 69, namely a first parallelepipedic magnet or ferromagnetic element 68, and a second parallelepipedic magnet or ferromagnetic element 69 with a fork 70 at one end, one of the ends 71 of the magnet 68 being inserted into the said fork, and held in place as it rotates in relation to the magnet 69 via an axis 72 for example in plastic material, the magnet 68 being attached to the centre of the said axis in such a way that the magnets 68 and 69 are not in contact with each other.

A hinged magnet therefore allows a degree of freedom in a transverse direction in relation to the longitudinal movement of hinged magnets, for example, in the sheath concerned.

FIGS. 2*o* to 2*y* show different embodiments of polarisation for the magnets used with the invention.

FIG. 2*o* shows a magnet 70' in the form of an oval block, from front to side views, the upper side being for example the north pole, and the lower side the south pole.

Figure 2P:
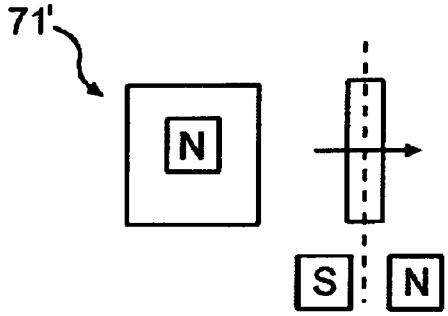

FIG. 2*p* shows a magnet or a ferromagnetic element 71' in the form of a rectangular block according to the invention, the upper side again being in this example the north face, and the lower side being the south face.

Figure 2Q:
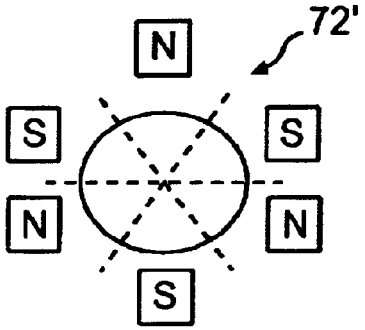

FIG. 2*q* shows a "multipolar" magnetised block 72'. This block 72', for example oval in shape, comprises a first sector magnetised positively, a second opposing sector magnetised negatively, this pattern being repeated for example over three different sector sections.

Figure 2R:
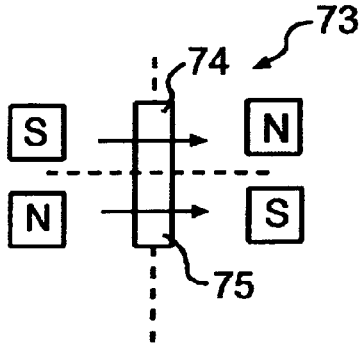

FIG. 2*r* is a cross-sectional view of another embodiment of a three-part magnet 73 according to the invention, of which a first end 74 is magnetised south-north and of which the other end 75 is magnetised north-south.

Figure 2S:
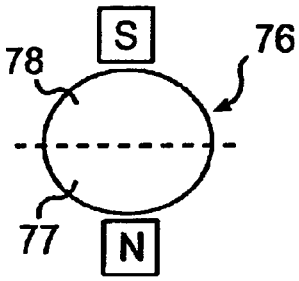
Figure 2T:
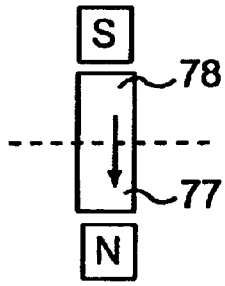

FIGS. 2*s* and 2*t* show a front view of two other embodiments of magnetisation and polarisation of two blocks, namely the first cylindrical block 76 of oval section of which a first cylindrical sector 77 is magnetised positively and the other cylinder section 78 is magnetised negatively.

Figure 2U:
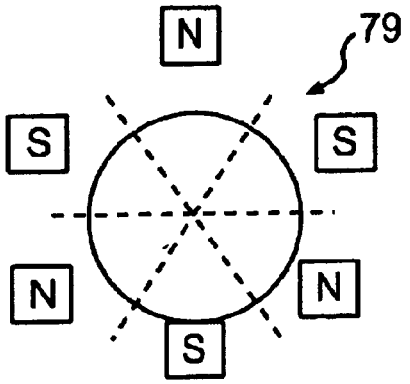

FIG. 2*u* shows another embodiment of a block 79 of a similar type to that represented in FIG. 2*q,* the block in this example being cylindrical rather than oval.

Figure 2V:
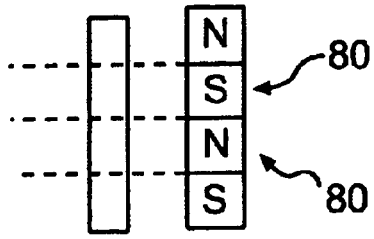

FIG. 2*v* shows an embodiment of two magnets 80 and 80' attached to each other with one part magnetised north, one part magnetised south, one part magnetised north and one part magnetised south, forming a parallelepipedic block.

Figure 2W:
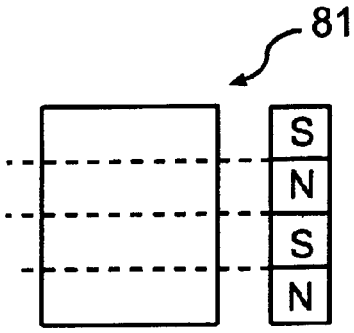
Figure 2X:
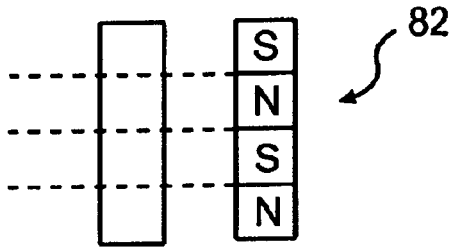
Figure 2Y:
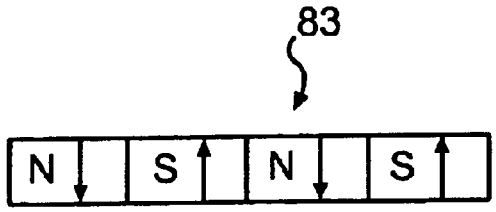

FIGS. 2*w,* 2*x* and 2*y* also show other embodiments of parallelepipedic blocks 81, 82 and 83, in front and/or cross-sectional views of different dimensions, either of a thickness approximately equal to the width, or of a smaller thickness, for example four times smaller than the width of the parallelepiped, and with alternating N/S orientations.

FIGS. 3*a,* 3*b,* 3*c,* 3*d* and 3*e* show embodiments of magnets 85 (for example parallelepipedic) according to the invention, in combination with a sheath 86 internally coated with ferromagnetic protective materials, this limiting the effects of magnetism on the user and/or his environment.

This protection of one or more surfaces of the magnet with a non-ferromagnetic and insulating material prevents the surfaces from emitting electromagnetic radiation towards the outside. Such protection may be made up of layers of stainless steel of the type AISI304, AISI304L, AISI305 or AISI306, with low carbon content.

This does not prevent the creation of effective magnetic attraction in the air-gap 88.

FIG. 3*e* shows an embodiment of protection 87 of the magnet 85 which may be used according to the invention, the protection 87 preventing leakage from the magnetic field, the framing of the parallelepipedic magnet and the external cylindrical shape of the protection 87 allowing almost total cancellation of the said magnetic fields.

The embodiment in FIG. 3*e* shows that the two ferromagnetic elements and magnets of the first and second parts can be protected in the same way.

The residual air-gap 88 between the two ferromagnetic elements or magnets is arranged so that the distances between the two are smaller than the width of the magnet divided by 6.

FIG. 3*f* is a schematic representation of a fastening between a magnet and ferromagnetic element for a multipolar bar magnet 90 when this magnet is magnetised alternately north-south as shown in FIG. 3*f,* between sections of magnets making up the same bar.

This thus ensures better efficiency of the system, particularly if a flux blocking fixed part 91 is added, for example a parallelepipedic strip in soft steel, on the rear side of the multipolar structure.

In this case, the binding power at the residual air-gap is the same as that of a fastening containing two identical multipolar structures.

However, it can be seen that in the presence of this residual air-gap, the reduction of the binding power is more marked when this type of structure contains an internal magnetic circuit.

In effect, everything is the same as in the fastening of the type described above in reference to FIGS. 2*o* or 2*p,* but with an effective air-gap double that of the actual air-gap.

It can also be seen that the efficiency of the soft iron can be improved by varying its thickness, for example in the case of a magnet measuring 15×13×11×3 mm, the piece of soft iron will be at least 2.5 mm thick.

To sum up, the use of a simple magnet in fabric sheathes in particular, gives high binding powers but produces leakage fields.

The devices described in reference to FIGS. 3*a* to 3*f,* which are also compatible with inclusion in fabric sheathes, can be used to limit, and even more or less eliminate this leakage.

In addition, the use of so-called periodic or multipolar structures, as described in reference to FIG. 2, will reduce the distant field while maintaining the binding powers identical to those of simple structures at an equal volume.

In addition, closed flux structures, of the type described in reference to FIG. 3*f,* particularly when the magnetic bar is sandwiched between two pieces of soft steel, will also minimise magnetic leakage.

In all cases, the width b of a magnet should be selected to be greater than the thickness e of the residual air-gap which is created by the fabric of the sleeve or sheath.

It is preferable to use a magnet width d six times greater than the air-gap and preferably twelve times greater than the air-gap in structures of the type described in reference to FIG. 3*f.*

FIGS. 3*g* and 3*h* show a simple representation of an embodiment of a magnet or ferromagnetic element 92 according to the invention which is welded or glued to a plate 93 in plastic material or any other material, allowing it in particular to be sewn (stitching 94) on the device or in the garment used. This method is therefore particularly suitable for the fixed part contained in the second part of the device.

FIGS. 3*j* and 3*k* similarly show a ferromagnetic element or magnet 95 which also has an insulating protective plate 97 between it and the plastic support wall 96, this plate for example being of the stainless steel type AISI304 as described above.

FIGS. 3*m* and 3*n* show the components of a device 100 according to the previous figures, in which the magnet 101 is embedded.

More specifically, FIGS. 3*m* and 3*n* show two embodiments of a magnet or ferromagnetic element which may be used according to the invention on a support 104, for example in plastic material, one being rectangular and parallelepipedic 102, the other being in the form of a cylindrical or oval block 103.

In this example, the plastic supports are constituted more specifically of elements in the form of a plastic insulating ring, into which the magnetic elements are embedded, anti-magnetic protection 105 being placed on one side of the magnet in order to protect the adjacent environment 106.

FIGS. 3*o* and 3*p* are a schematic representation of a device according to the invention, comprising a sheath of known fabric 107 with standard stitching 107' to which a ferromagnetic cloth 108 is added along all or part of its length.

The angle formed between the warp and weft of the ferromagnetic cloth and the sheath can for example be 120° (vertical, diagonal or horizontal weft of threads) as shown in FIG. 3*p*.

This device allows optimum contact because it means the air-gap otherwise created by a cloth placed between the magnets 109, can be replaced by a ferromagnetic type air-gap.

The aim here is to obtain a level of transmission almost identical to that produced by placing two magnets against each other.

Figure 3R:
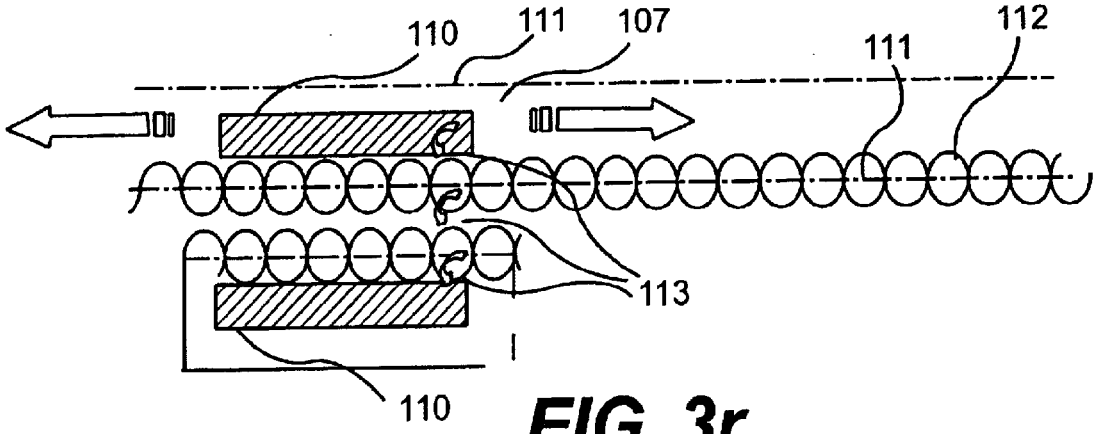
Figure 3S:
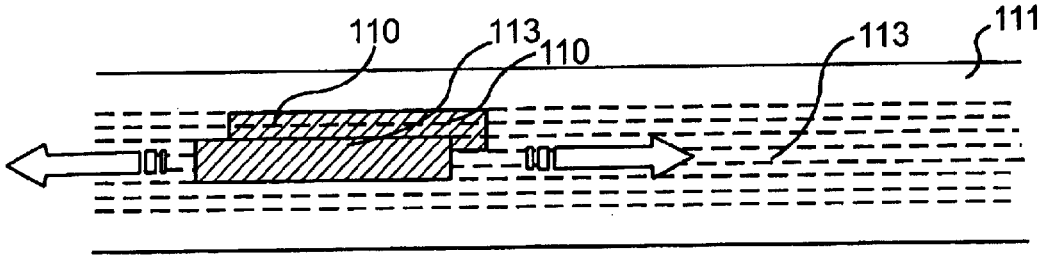

FIGS. 3*q*, 3*r* and 3*s* are schematic front and top views of a variant of the previous device, differing in that the sheath for the magnets 110 is of standard fabric 111 to which ferroconducting wire 112 is stitched.

It should be noted that the more stitches there are, the more effective magnetic transmission between the magnets will be (arrows or lines 113).

It is therefore possible to increase the efficiency of the basic systems by improving conductivity on magnetic contact, and therefore ensuring a more secure fastening.

Similarly, it will also be possible to improve miniaturisation of the magnets since large magnets are no longer necessary to perform an identical task, the size and dimensions of the magnets being inversely proportional to the air-gap.

Finally, the wire may also be an electric conductor wire allowing the transmission of electric signals, for example a signal being used to alert the user to check whether the garment is damaged.

In addition, the wire is designed to withstand the chemicals used during washing and to resist wear caused by friction or intensive use. It is also non-polluting and does not cause skin allergies.

To achieve this, galvanised stainless steel wire for example can be used which is very flexible and very fine and can be sewn using standard industrial sewing machines existing on the market or which already exist in factories.

FIG. 4*a* shows a cross-section of an embodiment of a block 113 according to an embodiment of the invention, for a ferromagnetic element or magnet.

This block comprises a central cylindrical part 114 and a rounded part at either end of the central cylindrical part in the form of a ring which therefore allows rounding of the corners.

This thus prevents marks appearing on the fabric 118 when ironing (iron 115) as shown in FIG. 4*b*, as opposed to what happens when a magnet 116 with square corners 117 is used as shown in FIG. 4*d*.

FIGS. 5*a*, 5*b*, 5*c* and 5*d* represent a motorised embodiment of at least one of the magnets or ferromagnetic elements according to the invention.

FIGS. 5*a* to 5*d* schematically represent a motor device 120, connected by a cable 121 to the magnet which is to be moved automatically using the motor.

FIG. 5*a* shows a ring-shaped magnet 122.

FIG. 5*b* shows a cylindrical magnet 123 containing a part capable of working in conjunction with a ferromagnetic element 124 of a complementary shape.

FIGS. 5*c* and 5*d* show the operation of a traction device which contains motorisation systems 120 or a spring pulled by a thread made out of flexible material such as that known under the trademark "Nylon", or by a reasonably flexible cable 121 welded onto the flat surface of a magnet 125 or the cylindrical part of the ferromagnetic element, this cable connecting the magnet and the traction system as shown.

The surface and edges of the magnets may be smooth, ribbed, granulated, or coated in order to further improve the efficiency of the system of manual or motorised adjustment obtained via a traction motor.

In the case of a garment or device which may be subject to humidity, the motorisation system must be sealed to avoid problems when washing, and for example when used in underwater environments.

FIGS. 5*e* and 5*f* show two schematic half-section views of a shoe 130, 131 with two embodiments 132, 133 of traction devices.

These devices are used to pull in the internal wall 134 using magnet 134', which result in the fastening and adjustment of the shoe.

FIG. 5*e* shows more specifically how the internal wall of the shoe is pulled in and fastened through rotation of the axis 135 via a cable 136, driven by the motor 137.

The top of the shoe's sole is represented in 138, the foot being schematised in 139, and a switch 140 for starting the motor being located on the sole of the feet.

FIG. 5*f* shows another embodiment directly controlling the rotation of the cylindrical magnet 134" which then pulls in the internal wall.

These two procedures can be used together to obtain more effective fastening of the shoe.

FIGS. 6*a* and 6*b* represent front and cross-sectional views of another principle of adjustment, this time applied to the hem 140 of trousers, jackets, skirts or any other garment.

Two embodiments are possible with reference to FIGS. 6*a* and 6*b*, in a first case one of the ferromagnetic elements or magnets 141 is cylindrical and the other 142 parallelepipedic; in the other case both 141 are cylindrical.

This device uses the basic principles of the invention and makes reference to FIGS. 2, 5*c* and 5*d*.

The user can adjust the hem and lining d of the garment to the required size by activating a system similar to the principle of adjustment for shoes described above, and this may include different variants applied to a hem or part of a garment such as those with detachable or retractable hoods.

In the case of FIG. 6*c*, dimensions can be automatically adjusted (motor 143 and cables 143') by storing the measurements of one or more users, or via a photoelectric cell 144 inserted in the garment.

Adjustment using a photoelectric cell makes it possible to locate the wrist or part of the body on which the garment will be adjusted.

A remote control device or a system 145 for automatic detection of external parameters such as cold, humidity and heat, can be also used to activate the cylindrical magnets 141 around axis 146, containing also and for example an adjustment microprocessor.

The second magnetised part may be replaced by a steel mesh type ferromagnetic cloth in order to improve its ability to adapt to the functions required.

FIGS. 6*d,* 6*e,* 6*f* and 6*g* show other principles of hem adjustment.

The device uses the basic principle, namely the sliding of a movable magnet 4 in a sheath 2, placing a fixed magnet 6 on one part 150 of the garment and bringing them together through magnetic contact 151.

The garment is adjusted by moving the movable magnet in the sheath.

This principle of adjustment can be adapted to all changes in relation to volume, size or height, and length or width of a garment.

It may be used for the hem of trousers, skirts, jackets or any other garment and may be used either horizontally or vertically.

The sides of a garment can be horizontally adjusted, making it easily possible to change the width of a garment from size 38 to size 42 without having to unstich and then resew the garment.

Vertical adjustments can also be made to alter the length of a hem.

In this case, clothing may be weighted 151 in order to improve the hang of certain garments.

FIGS. 7*a,* 7*b* and 7*c* show cross-sectional views of three examples of devices using elastic to horizontally and/or vertically fasten and tighten items according to an embodiment of the invention.

The fixed support 160 or elastic 161 or spring 162 moves in a sheath 163 to allow sliding adjustment.

In these three cases, traction is used to adjust the items as described in the following embodiments.

In FIG. 7*a,* the elastic is twisted horizontally 164 which pulls the tab 165 with the magnet 166 at its end.

In FIG. 7*b,* twisting is obtained by vertically pulling the elastic.

FIG. 7*c* operates through circular traction of a spring wound around an axis.

The three modes of traction can be adjusted or locked using an adjustment knurl (not shown).

The principle of adjustment includes a variant of the manual and/or automatic adjustment which is illustrated in FIGS. 7*a* and 7*b*.

Its principle is based on the use of the tab located in the sheath 163.

This tab has the magnet 166' at its outer end, which terminates on one side of the upper, and which will be held in place on the other side of the upper by another partially magnetised magnet which can be hidden in the lining on the top of the upper.

Adjustment can then be carried out in two ways, by pulling the elastic vertically (FIG. 7*a*) or by pulling the elastic horizontally (FIG. 7*b*), which comprises a cable wound around an elastic and/or a flexible coiled material or another type of spring-operated system.

In reference to the different FIGS. 7*a,* 7*b* and 7*c,* the device may comprise a sufficiently large sheath 163 to house the fixed magnet or the metallic part and a second sheath designed to allow sliding of the movable magnet.

The system will therefore operate according to the following fundamental rules:

1. The pull between the two magnets allows garments to be fastened and adjusted.
2. The mobility of the second magnet allows the adjustment of the system by pulling the sheath that it contains.

FIGS. 7*d,* 7*e,* 7*f* and 7*g* show schematically the different principles of traction of a magnet in a sheath.

FIG. 7*d* shows the possibility of pulling on two magnets 180 and 181 and/or ferromagnetic elements, the first part and second part being opposite each other and each one having a sheath 182.

FIG. 7*e* represents the principle of pulling a parallelepipedic magnet 183 via an axis 184, activated by a cable 185.

FIG. 7*f* represents a similar principle of traction of a cylindrical element 186.

FIGS. 7*g* and 7*h* show traction via a cable 187 of an insulating cap 188, attached to the magnet 189 for example via an anti-magnetic protective device in the sheath 191, the active polarised face 190 being towards the top in the figure.

FIGS. 7*i,* 7*j,* 7*k,* and 7*m* show principles of motorisation identical to those described in reference to the FIGS. 7*d,* 7*e,* 7*f,* 7*g* and 7*h* but in these examples traction of the elastic is provided by a tab 192 and a cable 193 that the user will pull to bring a tab magnet to the end of the sheath.

This sheath may have a hole in it so that the cable and tab protrude from it.

The cable is for example screwed, welded or glued to the magnet itself.

FIGS. 7*n* and 7*o* show a principle identical to that of the previous figures but in these examples the magnet 194 is welded, screwed or glued to a base 195 made out of elastic or plastic material which supports the magnet and which is used to accompany the magnet in its sheath.

Variants of cables are shown in FIGS. 7*p,* 7*r* and 7*s*.

FIG. 7*p* shows a cable 196 for example made out of known material under the trademark "Nylon", fitted at its end with a device 197 allowing the user to activate it, for example a pull or a grip tab.

FIG. 7*q* shows the use of an elastic 198, FIG. 7*r* the use of a thread 199 known under the trademark "Lycra" or similar, around an elastic thread 200, the aim being to allow the latter to retract without being pulled inside the sheath.

FIG. 7*s* shows another embodiment, this example using a guide spring 201 possibly with an elastic thread 202 and/or a cable 203.

FIGS. 8*a,* 8*b,* 8*c* and 8*d* give embodiment examples of magnets which may be used in particular with the invention.

The aim here is to design magnets which can be attached for example by stitching on a garment and/or other device.

To do this, the magnet 210 or ferromagnetic element is formed from a cylindrical or parallelepipedic block containing a central cylindrical recess 211 and a transverse channel 212 perpendicular to the axial recess and parallel to the upper surface 213 of the magnet through which a sewing thread can be run entirely below the said surface.

The channel can be open or closed, it can be duplicated, even triplicated, as can the central cylindrical recess, and allows an electric conductor wire 214 to run along it without any wire ever protruding in relation to this surface, this allowing effective fastening, the wire being for example a ferromagnetic or electric wire which can be also used for detection purposes.

FIGS. 8*e,* 8*f* and 8*g* show the magnets 220 of the type described above but containing this time at least two cylindrical holes 221 parallel to the axis of the block formed by this magnet and containing an upper cupel 222 through which the thread can run without there being any risk of protrusion in relation to the active surface 223 which will be in contact via the air-gap with the magnet or the ferromagnetic element opposite it and which it works in conjunction with.

Such buttons can be easily added by a manufacturer using a button sewing machine and standard thread (such as cotton or cotton polyester) or even stainless steel wire, or copper or silver-copper electric wire, with or without sheathing.

FIGS. 8*f* and 8*g* show variants with magnetic insulation on one side 224 or on one side and the walls, the inner side, and the lateral walls 225 of the magnet or ferromagnetic element.

FIGS. 8*h,* 8*i* and 8*j* show several blocks 226, 227 of magnets according to the invention, containing one or two axial openings 221 through which the thread or wire runs, arranged along a vertical strip, for example a long and narrow strip, used to magnetise a corresponding area around these elements, the said elements being alternate and capable of connecting one to the other as shown in FIG. 8*j.*

FIGS. 8*o* and 8*p* show a device 230 using blocks 231, 232 with conductor wire 233 as described in reference to the FIGS. 8*h,* 8*i* and 8*j,* which may be connected to a detection system 234 of a known type and containing in particular an alarm 235 and/or a voice transmitter 236.

The aim here is to allow the fastening of two parts of a garment and avoid fastening buttons which are not designed to fasten together.

An electrical signal can be transmitted by means of the wires connected to the magnets.

Thus, if the buttons are not connected, an alarm message will indicate that the garment is not properly fastened and that there is a risk of contamination and/or irradiation, etc.

FIGS. 8*q,* 8*r* and 8*s* are of the type described in reference to FIGS. 8*o* and 8*p,* the device 240 being in addition connected 240' by a remote control system 241, for example an infrared system, to a sensor 242 which will allow the opening of one part 243 and the wearer of the garment to move from one room to another.

Thus, if the garment is incorrectly fastened, the user will not be allowed to go back in to the room.

FIGS. 8*t,* 8*u* and 8*v* show an additional principle to the device 240 described above in reference to FIGS. 8*q,* 8*r* and 8*s,* intended for safety clothing 243', in particular for laboratories, which must not under any circumstances have any holes or the user risks contamination.

This principle comprises a specially adapted cloth 250 in which fine conductor wire 251, either copper or copper-silver type, and sheathed or unsheathed, is screwed to the inner surface of the preferred type of fabric 252.

This wire transmits an electric current (battery 253) designed to confirm that the garment is neither damaged nor has holes in it.

If the garment is damaged, the thread will be cut and the current no longer passes through it.

A signal is then transmitted to warn of the danger.

It goes without saying that only low voltage current is used.

FIG. 8*t* shows that the wire can be guided around an elastic thread, in order to increase the elasticity of the fabric and therefore the ease with which the garment is worn.

This newly constituted wire can itself be covered with an insulating sheath.

FIGS. 9*a,* 9*b* and 9*c* show embodiments of clothing according to the invention.

Figure 9B:
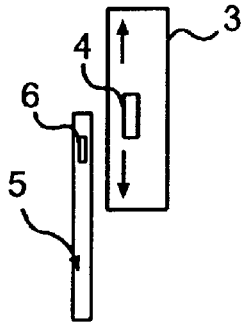

FIG. 9*a* shows a pair of overalls 260 with braces 216 containing a device according to the invention, as represented on FIG. 9*b* equivalent to FIG. 1*a,* this allowing adjustment of the length of the braces.

After putting on the overalls, the user must place the magnets in a position of attraction, the latter attracting and sticking to each other, which results in the two pats of the garment being held firmly together.

He then positions the fixed part in the body of the garment against the movable part(s) in the braces and then pulls on the brace(s) in order to adjust the overalls to the correct length.

This particularly innovative and recreational way of fastening and adjusting clothes allows children in particular to get dressed and undressed on their own.

It also allows immediate adjustment to the changing measurements of children and increases the lifetime of children's overalls, for example through easy alteration to reflect their growth.

In the case of overalls, the sliding of the magnet in the sheath of the braces allows this contact, adjustment and fitting to the measurements of the child.

Figure 9C:
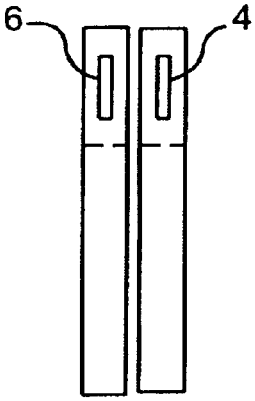

The sides and crotch of the garment can also be fastened by joining the fixed parts as described above, these being comprised of magnets or metallic parts placed in one or more sheathes or using magnets or metallic parts drilled with holes and stitched in place on the parts of the garment as shown in FIG. 9*c.*

FIG. 10 shows underwear 262, the size 263 of which can also be horizontally adjusted with a device according to the invention.

FIGS. 11*a,* 11*b* and 11*c* show a device for adjusting skirts 264, trousers 265 or belts 266 using the principle of the invention.

The device uses the principles outlined above and allows adjustment of a belt, for example with two sets of two magnets, each set comprising one fixed 270 and another movable 271 magnet, in such a way as to provide effective contact over a sufficient length of the belt.

In the case of skirts or trousers, this system allows users to lose or put on weight as they please without having to change their wardrobe.

The principle of sliding between two sheathes placed opposite each other is the preferred arrangement for this device.

FIGS. 11*d,* 11*e* and 11*f* show another embodiment, this time applied to a jacket 273 and using the principle 274 described more specifically and particularly in reference to FIG. 11*a.*

FIGS. 11*g,* 11*h,* 11*i,* 11*j* and 11*k* give other variants of the device applied to a jacket, but this time the belt (buckle 276) is added to the jacket and adjustment can for example allow correct reinforced fastening, for example using a buckle 275, the action of which guarantees that the jacket is correctly done up.

Figure 11M:
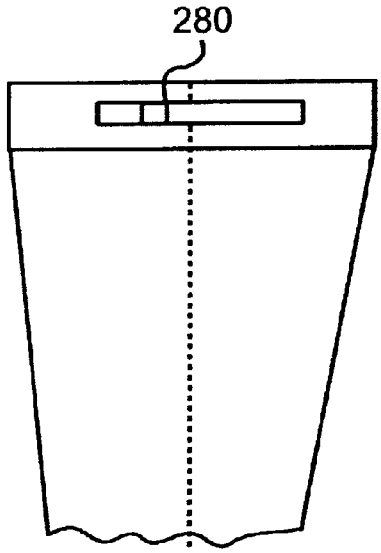
Figure 11N:
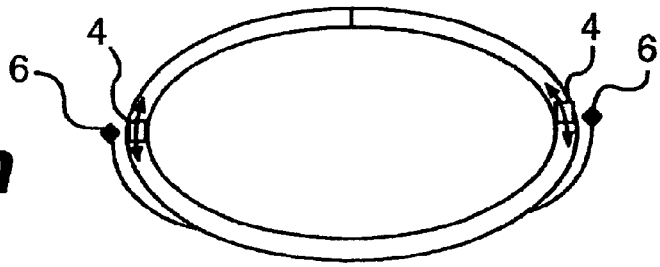

FIGS. 111, 11*m* and 11*n* show devices 280 which in these examples are on either side of the belt and no longer only at the front.

The devices described in reference to FIG. 12 use the basic principles of the previous devices, and will allow, for example, children to easily put on and/or take off their shoes.

The top view in FIG. 12*a* shows a shoe 300 containing two solid sections 301 and 302 and one open section 303 separating the solid sections.

The shoes have for example three straps 304 attached to the right or left section 301 or 302 and containing in the length of the strap a sheath with a movable magnet 305 used to fasten the left and right sections together.

The right section 302 contains a fixed magnet 306.

Figure 12B:
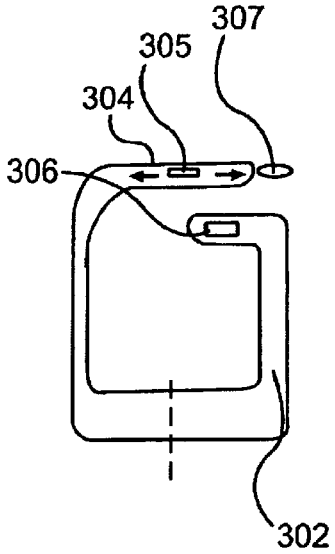
Figure 12C:
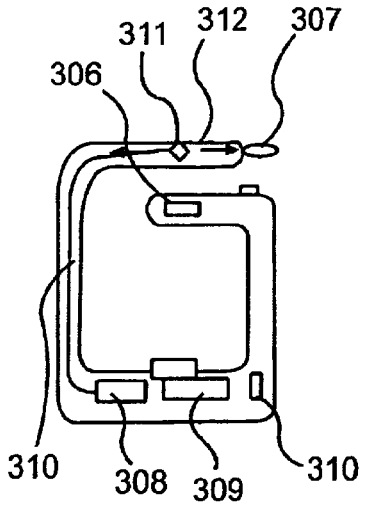
Figure 12D:
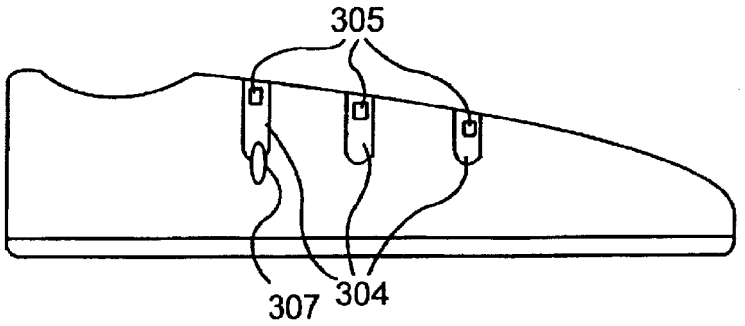

FIGS. 12*b* and 12*c* use cross-sectional views to show the operation of the system according to the invention.

The user, having put the pair of shoes on, activates the fixed part against the movable part(s), the action of the magnets and ferromagnetic elements allowing secure fastening between the sheath and the fixed part.

The user then pulls on the tab 307 located at the end of the sheathes towards the sides to bring them closer to the central part, thus adjusting the shoe to his foot.

If motorisation is used, as described in reference to the cross-section in FIG. 12*c,* a motor 308 or a spring-operated system, powered by a battery 309, with the option of control by a microprocessor 310, pulls a cable 310 attached to the magnet or ferromagnetic element 311 and allows adjustment of the shoe, this adjustment, for example, being associated with an adjustment knurl with the option of locking (not shown).

A control device, which may for example and in addition be activated by the heel of the user will start motorisation via a batter, this pulling with a single or double cable, for example in material known under the trademark "Nylon", the magnet for example of cylindrical form, for example coated with a layer of latex. This pulls the sheath 312 until the shoe is tightened.

This sheath may be associated with a control system assisted by a brain type microprocessor the principal functions of which are to ensure that the shoe is not over-tightened and to store the different adjustments adapted to the different uses of the said pair of shoes.

The device comprises a system for switch-operated adjustment of the shoe which, once again, may be in the sole, this allowing remote automatic adjustment of the shoe by remote control when the user puts his foot in the said shoe.

A disabled person for example will be able to activate it when he puts his foot in the shoe, this allowing gradual and automatic adjustment of the shoe.

FIG. 13*a* shows another embodiment of a shoe 320 according to the invention.

Two solid sections, on the right 321 and left, are separated by an open section 322.

Several straps 323, made up of adjustment sheathes 326, are used, the fixed magnets 324 being attached to the solid sections and the movable magnets 325 in their sheathes being integral to the straps.

By means of the end tabs 327, the user can therefore tighten the shoe to the required shape by simultaneously pulling on the two tabs.

A device, for example a cord type arrangement, should preferably be included so that the tab does not disappear inside the sheath.

Figure 13B:
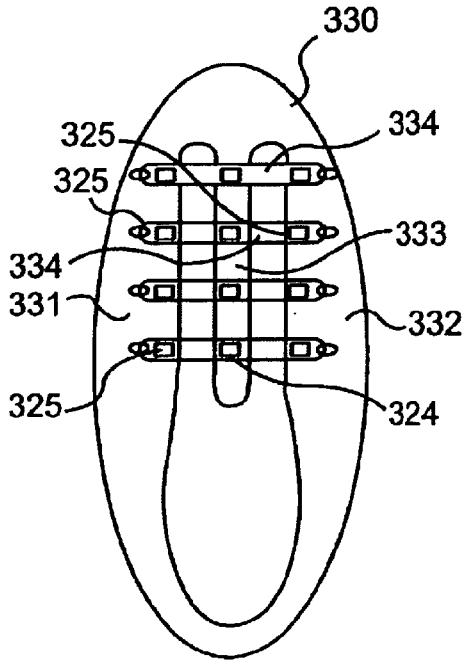
Figure 13C:
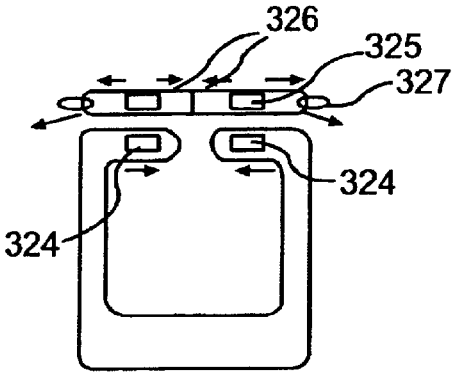

FIG. 13*b* shows another embodiment of a shoe 330 according to the invention containing this time three solid sections, namely a right section 331, a left section 332 and a central section 333, and two open sections, each one separating the two solid sections on either side of it.

The device here has for example three or four straps 334 attached in the middle to the central section with fixed magnets and with sheathes 326 on either side containing movable magnets 325 used to fasten the right and left sections to the central section in order to adjust the tightening of the shoe.

In this example the straps or sheathes contain three magnets, namely two movable magnets 325 in the sheathes on the sides and one fixed magnet 324 in the centre.

These straps can also be fastened to the centre with the central magnet, the shoe being adjusted by simultaneously pulling the straps towards the right and left sides of the shoe.

Figure 13D:
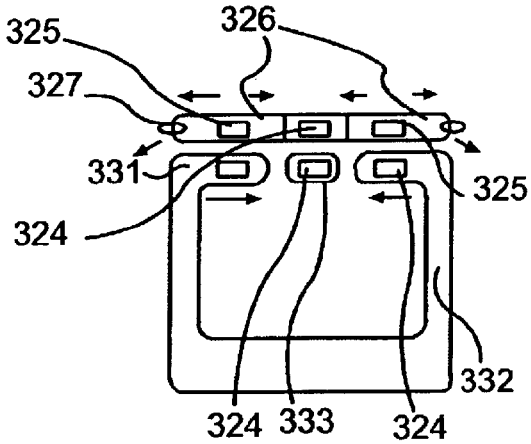

FIGS. 14*a,* 14*b,* 14*c* and 14*d* show another embodiment of the invention of the type of shoe described in FIGS. 13*b* and 13*d.*

In this example the straps 330 are attached at their ends by magnets which will be activated by internal motors 331, the said straps being inserted inside the shoe in a double wall 332 and connected to a motor system, for example a spring which will allow them to be retightened.

The ends of the straps 330 are held in place with a magnet 333, 334 by means of another magnet 335 attached to the central section.

Device 340 in FIGS. 15*a* and 15*b* uses the basic principle of the previous device. In this example, it has a different and more discrete adjustment and fitting system, as it is internal and inserted inside 341 a double wall in the shoe.

These are therefore no straps 342 or adjustment sheathes hanging outside the shoe after tightening.

When adjusted, the adjustment sheathes are housed in the empty space between the inner wall and the right-hand side, the left-hand section being the point from which these straps start.

A fastening method in FIGS. 15*a* and 15*b* also uses for example a cable 343 which is accessed by a spring or motor as described above.

The cable is attached to the end 344 of the tab.

FIGS. 16*a,* 16*b,* 16*c* and 16*d* show another embodiment of a device 350 which once again uses the basic principles of the previous device.

It has a different adjustment and fitting system. In this sense, it is also internal but in the opposite direction, allowing adjustment which is equally effective.

Figure 16B:
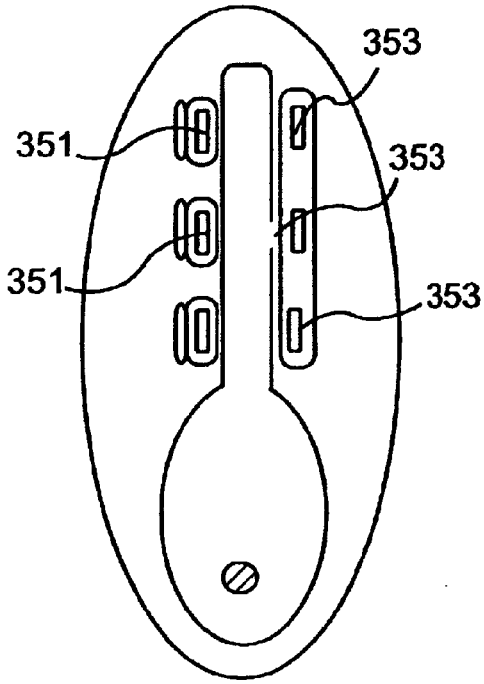
Figure 16C:
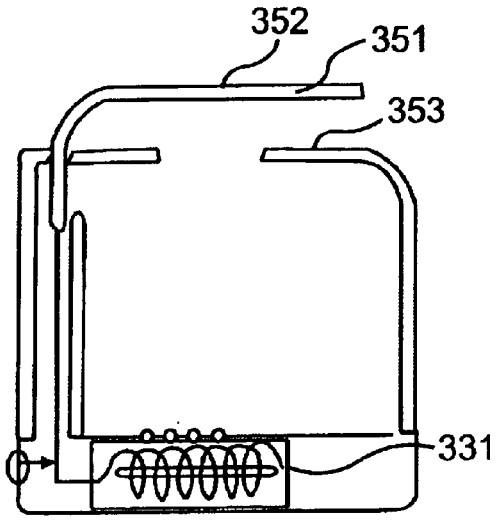
Figure 16D:
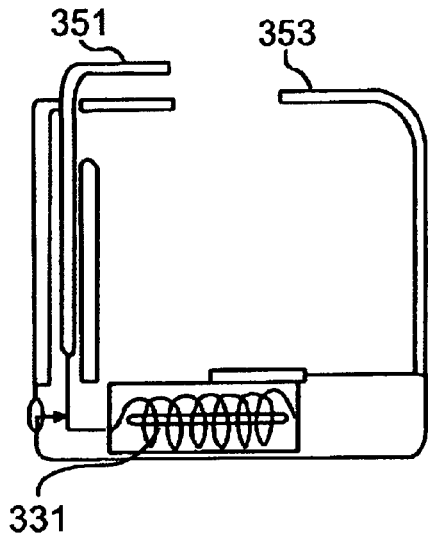

FIG. 16*b* shows the system when it is open, that is, when the end magnets 351 of the straps 352 are separated from the fixed magnet 353 in the right-hand part of the device.

FIGS. 17*a* and 17*b* use the principles described in FIGS. 6*a* and 6*b,* applied in this example to a shoe 360 which is fastened without using the hands, through contact of the foot on the floor 361 of the shoe which contains a switch 362 to activate the device, bringing the magnets 362 together to adjust the fastening.

Figure 17F:
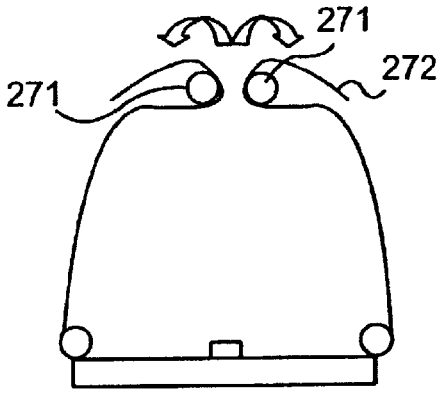
Figure 17H:
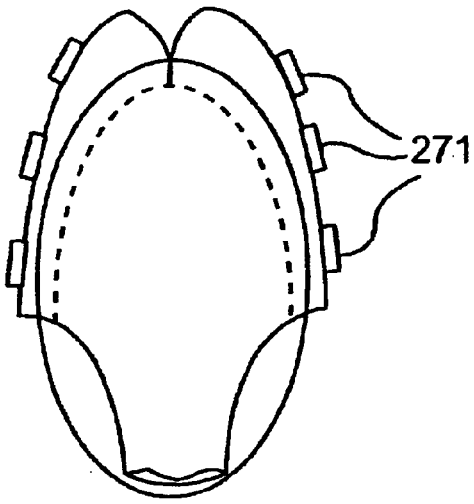

FIGS. 17*c,* 17*d,* 17*e,* 17*f* and 17*g* are operational variants of the corresponding device showing schematic cross-sectional and top views. In this example, the side sections 370 of the shoe can be fully separated from each other and when they are brought together, the magnets in the sheath 371 will connect to each other (FIG. 17*f*), and pulling on the ends 372 of the tabs allows effective tightening.

Figure 17I:
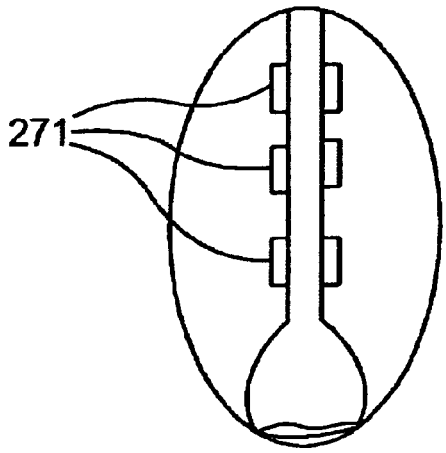

FIGS. 17*i* and 17*j* show a system for shoes in which the tab 380 crosses the end 381 of the left section of the shoe to then come back to the right section and two sliding magnets 382 are placed firstly at the end 383 of the tab pulled out from the right section, and secondly on a portion of the tab before it passes through the end of the left section.

The magnets will therefore work in conjunction with each other and allow a double tightening through the sliding of the tabs around the magnets.

FIGS. 18*a,* 18*b* and 18*c* show a garment 390 using the principles of tightening in a horizontal adjustment device, for example for a dress, a shirt, a pair of trousers or any other garment according to the invention.

This system allows horizontal adjustment through two or more magnets 391 or ferromagnetic elements arranged in the belt 392 at the sides 393 of the garment, which means that when the magnets are connected to each other, it is then possible to pull via the end of the sheath (not shown) to tighten the waist on one or either side.

FIGS. 19*a* and 19*b* show a device 400 for adjusting a doctor's or dentist's coat 401 with a detachable bib that can be easily renewed for each patient.

This device still uses the principle of fastening clothing by sliding a magnet 402, 403 or ferromagnetic element in a sheath 404 level or approximately level with the top 405 of the coat.

The bit has two or more magnets or ferromagnetic elements so that it can be attached to the coat without the wearer having to have a cord around his neck.

For easy manufacture, the invention will require the use of specific sewing tools. The surface of the work area is thus adapted to facilitate the insertion of the magnets. It is made from material which insulates it from the magnetic fields, by creating a significant air-gap between the elements and the machine.

Anti-magnetic protection on the table is preferable as is an oval, square or any other shaped recess adapted to the function required, thus allowing the insertion of the magnet.

The use of tools such as presser feet and scissors made from non-ferromagnetic material in order to facilitate the insertion of the magnets is also necessary.

Given that it is self-evident and given what has been written above, this invention is not limited to the embodiments more specifically described, on the contrary it covers all variants, and particularly those in which the devices are applied to elements other than those specifically described in relation to clothing.

What is claimed is:

1. A device for holding together, adjusting, fitting or fastening parts of a garment, shoe, or any other accessory, comprising:

a first part containing at least one first sheath in which at least one first magnetic or ferromagnetic element is inserted, the first element being movable inside said first sheath, and a second part containing at least one sheath magnetic or ferromagnetic element subject or submitted to the magnetic attraction of the first magnetic or ferromagnetic element of the first part, wherein the first and second parts used to hold together, adjust, fit or fasten the garment, shoe or accessory when one of the first and second parts is activated by a user to work in conjunction with the other part, a multitude of adjustments or alterations being possible through the sliding of the first magnetic or ferromagnetic element in said first sheath, and wherein the second magnetic or ferromagnetic element is included and movable in a second sheath belonging to the second part.

2. A device as claimed in claim 1, wherein the first part and/or second part have two sheathes.

3. A device as claimed in claim 1, wherein one of the first and second parts is at least in part formed by a strap or braces.

4. A device as claimed in claim 3, wherein at least one of the first and second magnetic or ferromagnetic elements is formed by a magnetized or ferromagnetic area on said braces or strap belonging to the first or second corresponding part.

5. A device as claimed in claim 1, wherein the at least one magnetic or ferromagnetic element of one of the first or second parts of the device is concave in shape, and the at least one magnetic or ferromagnetic element of the other of the first and second parts is convex in shape and complementary to the concave shape of the at least one magnetic or ferromagnetic elements of the one of the first or second parts.

6. A device as claimed in claim 1, wherein in one or more of the magnetic or ferromagnetic elements are flat, trapezoid, rectangular, circular or triangular in shape.

7. A device as claimed in claim 6, wherein at least one magnetic or ferromagnetic element of one part is cylindrical.

8. A device as claimed in claim 7, wherein the corresponding magnetic or ferromagnetic element of the other part is flat.

9. A device as claimed in claim 7, wherein the corresponding magnetic or ferromagnetic element of the other part is cylindrical.

10. A device as claimed in claim 1, further including a means for mechanically moving the first sheath.

11. A device as claimed in claim 1, wherein at least one of the elements is surface-polarized.

12. A device as claimed in claim 1, wherein a polarization of at least one of the elements in axial, parallel to the sheath.

13. A device as claimed in claim 1, wherein at least one of the elements is multipolar.

14. A device as claimed in claim 1, further including at least two of the first elements in the first sheath, which two first elements are of opposite polarization.

15. A device as claimed in claim 1, wherein each element is associated with an anti-magnetic protection component.

16. A device as claimed in claim 1, wherein at least one element is multipolar, and said at least one element is sandwiched between two blocking parts used to block the magnetic flux.

17. A device as claimed in claim 1, wherein one of the first and second elements has a width 'd', and wherein a structural thickness of the device between the first and second elements is less than d/12.

18. A device as claimed in claim 1, wherein at least one magnetic or ferromagnetic element is glued, welded or embedded on a support plate.

19. A device as claimed in claim 1, wherein the first sheath also has a strip of ferromagnetic cloth along all or part of a length thereof.

20. A device as claimed in claim 1, wherein the first sheath also has stitches sewn with ferromagnetic conductor wire along at least part of a length thereof.

21. A device as claimed in claim 1, wherein the magnetic or ferromagnetic elements have rounded edges.

22. A device as claimed in claim 1, wherein the elements are produced from Neodymium Iron Boron rare earth magnets.

23. A device as claimed in claim 1, wherein at least one element is a magnet which is formed from a block drilled along an axis thereof with at least one cylindrical hole and containing, on a side of one of the surfaces thereof, a transverse channel parallel to said surface and through which sewing thread can be run entirely below said surface.

24. A device as claimed in claim 23, wherein the magnet has two cylindrical holes.

25. A device as claimed in claim 23, wherein the magnet is covered with an anti-magnetic sheath on at least one surface.

26. A device as claimed in claim 1, wherein at least one magnetic element is formed from a block drilled along an axis thereof with at least one cylindrical hole and containing, on a side of one of the surfaces thereof, a cupel through which sewing thread can be run entirely below said surface.

27. A device as claimed in claim 1, further including a means for detecting and signalling that the parts of the garment, shoe or any other accessory are correctly fastened or fitted.

28. A device as claimed in claim 27, wherein the detection and signalling means contains a circuit or conductor wires connected to the magnetic or ferromagnetic elements, said magnetic or ferromagnetic elements acting as contactors to close the circuit.

29. A device as claimed in claim 27, further including a means for triggering an alarm or sending a command if specific preset conditions are complied or not complied with.

30. A device as claimed in claim 1, wherein the accessory is a garment with a hem which is adjusted; and wherein the first sheath is extended by a piece of fabric to which the second magnetic or ferromagnetic element is attached.

31. A device as claimed in claim 30, wherein the garment is weighted inside the hem.

32. A shoe containing a device as claimed in claim 1, further including:

three solid sections, namely a right section, a left section and a central section, two open sections, each respective open section separating two respective solid sections on either side thereof, and at least one strap fixed to a middle on the central section and fitted on both sides with sheathes containing movable magnets, which said strap is used to bring the right and left sections towards the central section, in order to adjust tightening of the shoe.

33. A garment, containing a device as claimed in claim 1.

34. A garment as claimed in claim 33, further including a cloth, a weft of which said cloth is threaded with conductor wire connected to an alarm used to signal if the wire is cut and therefore that the garment is damaged.

35. An accessory, wherein the accessory contains a device as claimed in claim 1.

36. A device for holding together, adjusting, fitting or fastening parts of a garment, shoe, or any other accessory, comprising:

a first part containing at least one first sheath in which at least one first magnetic or ferromagnetic element is inserted, the first element being movable inside said first sheath, and a second part containing at least one second magnetic or ferromagnetic element subject or submitted to the magnetic attraction of the first magnetic or ferromagnetic element of the first part, wherein the first and second parts are used to hold together, adjust, fit or fasten the garment, shoe or accessory when one of the first and second parts is activated by a user to work in conjunction with the other part, a multitude of adjustments or alterations being possible through the sliding of the first magnetic or ferromagnetic element in said first sheath, and wherein at least one of the first and second parts has a series of at least two magnetic or ferromagnetic elements hinged together.

37. A device as claimed in claim 36, wherein the second magnetic or ferromagnetic element is attached to the second part.

38. A device for holding together, adjusting, fitting or fastening parts of a garment, shoe, or any other accessory, comprising:

a first part containing at least one first sheath in which at least one first magnetic or ferromagnetic element is inserted, the first element being movable inside said first sheath, and a second part containing at least one second magnetic or ferromagnetic element subject or submitted to the magnetic attraction of the first magnetic or ferromagnetic element of the first part, wherein the first and second parts are used to hold together, adjust, fit or fasten the garment, shoe or accessory when one of the first and second parts is activated by a user to work in conjunction with the other part, a multitude of adjustments or alterations being possible through the sliding of the first magnetic or ferromagnetic element in said first sheath, and further including a means for activation in the fist movable magnetic or ferromagnetic element remotely including a means for motorization of the at least one first movable magnetic or ferromagnetic element, allowing a mechanical movement of the corresponding first sheath and a means for locking said means for motorization in multiple positions.

39. A device as claimed in claim 38, further including a means for motorization of at least one first and at least one second magnetic or ferromagnetic element which is capable of working in conjunction with the at least one first element.

40. A device as claimed in claim 39, wherein the means for remote activation include a microprocessor which is used for automatic adjustment so that an item can be adapted during use, by limiting tightening, and thus ensuring optimum adjustment.

41. A device as claimed in claim 40, wherein the means for remote activation also include a means for storing different adjustments, corresponding to different users or situations.

42. A device as claimed in claim 38, wherein the means for remote activation include a photoelectric sensor, and/or a temperature sensor, and/or a humidity sensor.

43. A device as claimed in claim 38, wherein the means for remote activation include an elastic or spring-operated traction system attached or connected to the first movable magnetic or ferromagnetic element, and capable of acting through the corresponding first sheath, and a system for locking the said traction system in one or more preset positions.

44. A device as claimed in claim 43, wherein the traction system is attached to the first sheath, or passes through said first sheath.

45. A device as claimed in claim 38, wherein the accessory is a shoe; and wherein the means for remote activation include a switch located in a sole of the shoe, which can be activated by the user when he puts his foot in the shoe, this allowing automatic adjustment of the shoe.

46. A device as claimed in claim 38, wherein the accessory is a shoe; and further including:

three solid sections, namely, a right section, a left section and a central section, two open sections, each respective open section separating two respective solid sections on either side thereof, at least one strap fixed to a middle on the central section and fitted on both sides with sheathes containing movable magnets, which said strap is used to bring the right and left sections towards the central section, in order to adjust tightening of the shoe; and at least one adjustment strap containing a magnetic or ferromagnetic part which disappears into a wall of the shoe, such that the motorization means is capable of pulling or releasing the said adjustment strap automatically.

* * * * *